US006067053A

United States Patent [19]

Runyon et al.

[11] Patent Number: 6,067,053

[45] **Date of Patent: *May 23, 2000**

[54] DUAL POLARIZED ARRAY ANTENNA

[75] Inventors: Donald L. Runyon, Duluth; James E. Thompson, Jr., Lilburn; James C. Carson, Duluth, all of Ga.

[73] Assignee: EMS Technologies, Inc., Norcross, Ga.

[ * ] Notice: This patent is subject to a terminal disclaimer.

[21] Appl. No.: 08/733,399

[22] Filed: Oct. 18, 1996

Related U.S. Application Data

[63] Continuation-in-part of application No. 08/572,529, Dec. 14, 1995.

[51] Int. Cl.[7] ..... H01Q 21/26

[52] U.S. Cl. ..... 343/797; 343/700 MS; 343/820; 343/821; 343/829; 343/853

[58] Field of Search ..... 343/700 MS, 793, 343/795, 767, 797, 803, 815, 816, 817, 818, 819, 820, 821, 829, 853; H01Q 21/24, 21/26

[56] References Cited

U.S. PATENT DOCUMENTS

| | | | |
|---|---|---|---|
| 2,470,016 | 5/1949 | Clapp | 343/817 |
| 3,541,559 | 11/1970 | Evans . | |
| 3,545,001 | 12/1970 | Giller | 343/817 |
| 3,546,705 | 12/1970 | Lemson | 343/817 |
| 3,681,770 | 8/1972 | Alford | 343/815 |
| 3,742,512 | 6/1973 | Munson | 343/814 |
| 3,757,344 | 9/1973 | Pereda | 343/770 |
| 3,836,976 | 9/1974 | Monser et al. . | |
| 3,836,977 | 9/1974 | Wheeler | 343/815 |
| 3,854,140 | 12/1974 | Ranghelli et al. | 343/700 MS |
| 3,887,925 | 6/1975 | Ranghelli et al. . | |
| 4,051,474 | 9/1977 | Mack et al. | 343/756 |
| 4,089,817 | 5/1978 | Kirkendall | 343/713 |
| 4,097,868 | 6/1978 | Borowick | 343/727 |
| 4,130,823 | 12/1978 | Hoople | 343/768 |
| 4,186,400 | 1/1980 | Cermignani et al. | 343/778 |
| 4,315,264 | 2/1982 | DuHamel . | |

(List continued on next page.)

FOREIGN PATENT DOCUMENTS 0 342 175 11/1989 European Pat. Off. .

OTHER PUBLICATIONS

"Reflector Antenna Analysis and Design", by P.J. Wood, published by the Institution of Electrical Engineers, London and New York, copyright 1980, pp. 24–27 and 123–151.

"An Improved Element for Use in Array Antennas", by A. Clavin, D.A. Huebner, and F.J. Kilburg, IEEE Transactions on Antennas and Propagation, vol. AP–22, No. 4, Jul., 1974, pp. 521–526.

"The Definition of Cross Polarization", by A. C. Ludwig, IEEE Transactions on Antennas and Propagation, vol. AP–21, Jan., 1973, pp. 116–119.

"The Latest in Cellular and PCS" by H. Bainbridge, Wireless Product News, Jan. 1996, pp. 16–18.

*Primary Examiner*—Don Wong
*Assistant Examiner*—Tho Phan
*Attorney, Agent, or Firm*—Jones & Askew, LLP

[57] ABSTRACT

A planar array antenna having radiating elements characterized by dual simultaneous polarization states and having substantially rotationally symmetric radiation patterns. A distribution network, which is connected to each dual polarized radiator, communicates the electromagnetic signals from and to each radiating element. A ground plane is positioned generally parallel to and spaced apart from the radiating elements by a predetermined distance. The conductive surface of the ground plane operates to image the radiating elements over a wide coverage area, thereby enabling a radiation pattern within an azimuth plane of the antenna to be independent of any quantity of radiating elements. Side walls, placed on each side of the array of radiators, can operate in tandem with the ground plane, to reduce the half-power beamwidth in the azimuth plane for a selected radiator design. A central polarization control network (PCN), which is connected to the distribution network, can control the polarization states of the received signals distributed via the distribution network by the radiating elements.

46 Claims, 25 Drawing Sheets

U.S. PATENT DOCUMENTS

| | | | |
|---|---|---|---|
| 4,342,997 | 8/1982 | Evans . | |
| 4,434,425 | 2/1984 | Barbano | 343/814 |
| 4,516,132 | 5/1985 | Bond et al. | 343/815 |
| 4,518,969 | 5/1985 | Bogner | 343/819 |
| 4,672,386 | 6/1987 | Wood | 343/770 |
| 4,686,536 | 8/1987 | Allcock . | |
| 4,740,793 | 4/1988 | Wolfson et al. | 343/700 MS |
| 4,816,835 | 3/1989 | Abiko et al. | 343/700 MS |
| 4,912,482 | 3/1990 | Woloszczuk | 343/841 |
| 4,918,457 | 4/1990 | Gibson | 343/700 MS |
| 4,983,988 | 1/1991 | Franke . | |
| 5,041,838 | 8/1991 | Liimatainen et al. | 343/700 MS |
| 5,111,214 | 5/1992 | Kumpfbeck et al. | 343/815 |
| 5,206,655 | 4/1993 | Caille et al. | 343/700 MS |
| 5,216,430 | 6/1993 | Rahm et al. | 343/700 MS |
| 5,241,322 | 8/1993 | Gegan | 343/700 MS |
| 5,264,862 | 11/1993 | Kumpfbeck . | |
| 5,268,701 | 12/1993 | Smith | 343/767 |
| 5,309,164 | 5/1994 | Dienes et al. | 343/700 MS |
| 5,319,378 | 6/1994 | Nalbandian et al. | 343/700 MS |
| 5,325,103 | 6/1994 | Schuss | 343/700 MS |
| 5,434,575 | 7/1995 | Jelinek et al. | 342/365 |
| 5,461,394 | 10/1995 | Weber | 343/786 |
| 5,469,181 | 11/1995 | Yarsunas | 343/815 |
| 5,568,162 | 10/1996 | Samsel et al. . | |
| 5,748,156 | 5/1998 | Weber | 343/762 |
| 5,757,246 | 5/1998 | Johnson | 333/12 |

ANTENNA BLOCK DIAGRAM

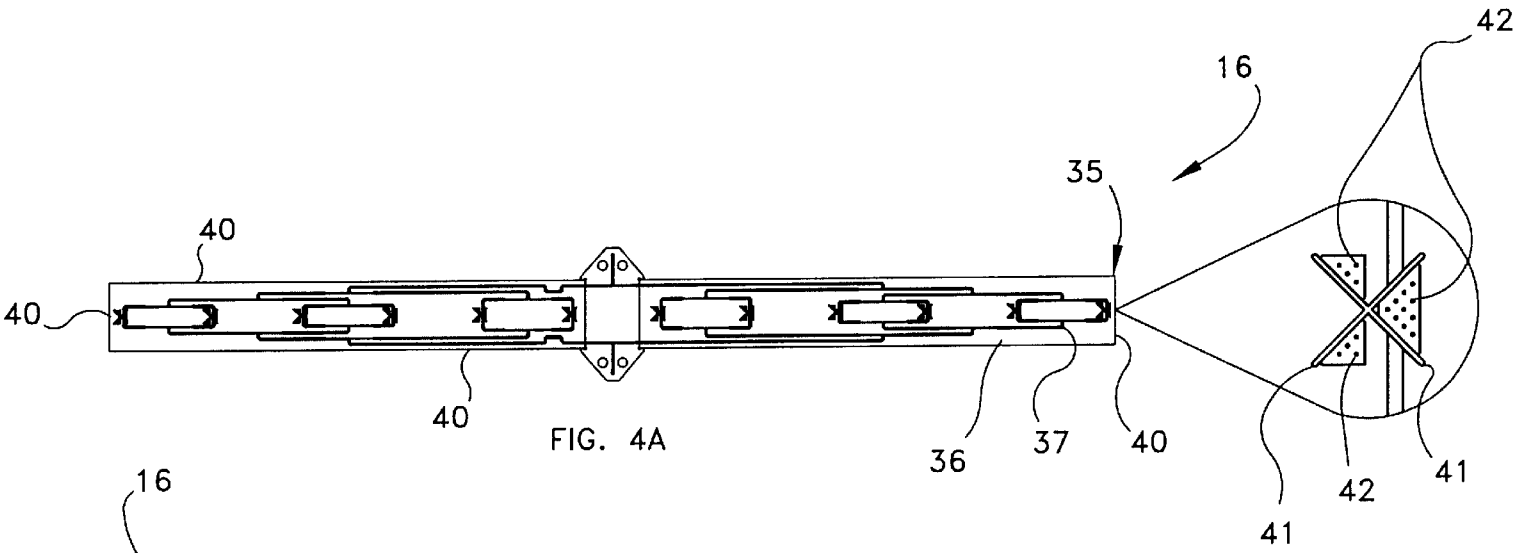
FIG. 4A
FIG. 4B
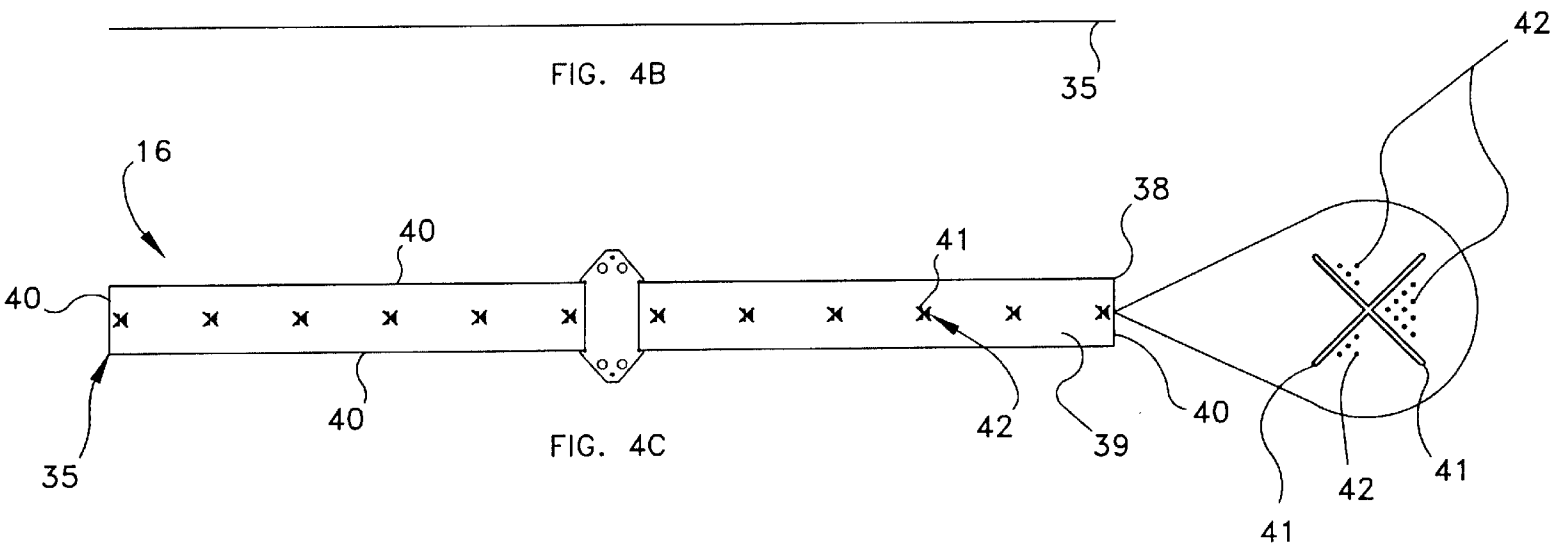
FIG. 4C

ANTENNA BLOCK DIAGRAM

ANTENNA BLOCK DIAGRAM

ANTENNA BLOCK DIAGRAM

POLARIZATION FORMING NETWORKS (PCNs)

FULL POLARIZATION FLEXIBILITY SCHEMATIC

DUAL POLARIZED ARRAY ANTENNA

RELATED APPLICATION

The present application is a continuation-in-part of U.S. Pat. application Ser. No. 08/572,529, entitled "Dual Polarized Array Antenna with Central Polarization Control" filed on Dec. 14, 1995.

TECHNICAL FIELD

The present invention is generally directed to an antenna for communicating electromagnetic signals, and relates more particularly to a planar array antenna having wave radiators exhibiting dual polarization states and aligned over a ground plane of sufficient radio-electrical size to achieve substantially rotationally symmetric radiation patterns.

BACKGROUND OF THE INVENTION

Diversity techniques at the receiving end of a wireless communications link can improve signal performance without additional interference. Space diversity typically uses two or more receive antennas spatially separated in the plane horizontal to local terrain. The use of physical separation to improve communications system performance is generally limited by the degree of cross-correlation between signals received by the two antennas and the antenna height above the local terrain. The maximum diversity improvement occurs when the cross-correlation coefficient is zero.

For example, in a space diversity system employing two receive antennas, the physical separation between the receive antennas typically is greater than or equal to eight (8) times the nominal wavelength of the operating frequency for an antenna height of 100 feet (30 meters). Moreover, the physical separation between antennas typically is greater than or equal to fourteen (14) times for an antenna height of 150 feet (50 meters). The two-branch space diversity system cross-correlation coefficient is set to 0.7 for the separations identified above. At an operating frequency of 850 MHz, a separation factor of 8 wavelengths between receive antennas creates a ±2 dB power difference, which provides a sufficient improvement of signal reception performance for the application of the diversity technique. For a communications system operating at 850 MHz, the physical separation of the receive antennas is approximately nine feet (3 meters).

Site installation issues become increasingly impractical for lower frequency applications for which the wavelength is greater. For instance, the antenna separation required at 450 MHz is nearly 18 feet for equivalent space diversity performance assuming the same height criteria is applicable. Although the site installation issues would be relieved for higher frequencies because of the reduction in the baseline distance required for diversity performance, there is a need to reduce the physical presence of base station antennas to improve the overall appearance of the antenna within its operating environment and to improve the economics of the site installation.

Present antennas for wireless communications systems typically use vertical linear polarization as the reference or basis polarization characteristic of both transmit and receive base station antennas. The polarization of an antenna in a given direction is the polarization of the wave radiated by the antenna. For a field vector at a single frequency at a fixed point in space, the polarization state is that property which describes the shape and orientation of the locus of the extremity of the field vector and the sense in which the locus is traversed. Cross polarization is the polarization orthogonal to the reference polarization.

Space diversity antennas typically have the same vertical characteristic polarization state for the receive antennas. Space diversity, when applied with single polarization antennas, is incapable of recovering signals which have polarization characteristics different from the receive antennas. Specifically, signal power that is cross polarized to the antenna polarization does not effectively couple into the antenna. Hence, space diversity systems using single polarized antennas have limited effectiveness for the reception of cross-polarized signals. Space diversity performance is further limited by angle effects, which occur when the apparent baseline distance between the physically separated antennas is reduced for signals having an angle of arrival which is not normal to the baseline of the spatially separated array.

Polarization diversity provides an alternative to the use of space diversity for base stations of wireless communications systems, particularly those supporting Personal Communications Services (PCS) or cellular mobile radiotelephone (CMR) applications. The potential effectiveness of polarization diversity relies on the premise that the transmit polarization of the typically linearly polarized mobile or portable communications unit will not always be aligned with a vertical linear polarization for the antenna at the base station site or will necessarily be a linearly polarized state (e.g., elliptical polarization). For example, depolarization, which is the conversion of power from a reference polarization into the cross polarization, can occur along the propagation path(s) between the mobile user and base station. Multipath propagation generally is accompanied by some degree of signal depolarization.

Polarization diversity may be accomplished for two-branches by using an antenna with dual simultaneous polarizations. Dual polarization allows base station antenna implementations to be reduced from two physically separated antennas to a single antenna having two characteristic polarization states. Dual polarized antennas have typically been used for communications between a satellite and an earth station. For the satellite communication application, the typical satellite antenna is a reflector-type antenna having a relatively narrow field of view, typically ranging between 15 to 20 degrees to provide a beam for Earth coverage. A dual polarized antenna for a satellite application is commonly implemented as a multibeam antenna comprising separate feed element arrays and gridded reflecting optics having displaced focal points for orthogonal linear polarization states or separate reflecting optics for orthogonal circular polarization states. An earth station antenna typically comprises a high gain, dual polarized antenna with a relatively narrow "pencil" beam having a half power beamwidth (HPBW) of a few degrees or less.

The present invention provides the advantages offered by polarization diversity by providing antenna having an array of dual polarized radiating elements arranged within a planar array and exhibiting a substantially rotationally symmetric radiation pattern over a wide field of view. In contrast to prior dual polarized antennas, present invention maintains a substantially rotationally symmetric radiation pattern for HPBW within the range of 45 to 120 degrees. A high degree of orthogonality is achieved between the pair of antenna polarization states regardless of the look angle over the antenna field of view. The antenna dual polarizations can be determined by a centrally-located polarization control network (PCN), which is connected to the array of dual polarized radiators and can accept the polarization states of received signals and output signals having different predetermined polarization states. The antenna of the present invention can achieve a compact structure resulting in low radio-electric space occupancy, and is easy and relatively inexpensive to reproduce.

SUMMARY OF THE INVENTION

The present invention is generally directed to a dual polarized planar array antenna having radiating elements characterized by dual simultaneous polarization states and having substantially rotationally symmetric radiation patterns. A substantially rotationally symmetric radiation pattern is a co-polarized pattern response having "pseudo-circular symmetry" properties and principal (E- and H-) plane patterns that are different by no more than approximately 3.1 dB at any value of theta over the field of view for the antenna. Alternatively, a substantially rotationally symmetric radiation pattern can be viewed as a co-polarized pattern response having "pseudo-circular symmetry" properties and a cross-polarization less than approximately −15 dB within the field of view for the antenna.

A beam forming network (BFN), typically implemented as a distribution network, is connected to each dual polarized radiator and communicates the electromagnetic signals from and to each radiating element. A ground plane, typically provided by the tray of the antenna chassis, is positioned generally parallel to and spaced apart from the radiating elements by a predetermined distance. The ground plane typically has sufficient radio-electric extent in a plane transverse to the antenna to image the radiating elements over a wide coverage area, thereby enabling a radiation pattern within an azimuth plane of the antenna to be independent of any quantity of the radiators.

More particularly described, the present invention provides an antenna having a planar array of dual polarized radiating elements characterized by dual simultaneous polarization states and having substantially rotationally symmetric element radiation patterns. The array radiation patterns comprise a first radiation pattern in an elevation plane of the antenna and a second radiation pattern in an azimuth plane of the antenna. The first radiation pattern is defined by the geometry of the antenna system and the second radiation pattern is defined by the characteristics of the dual polarized radiating elements and the ground plane.

Each dual polarized radiating element can be implemented as a crossed dipole pair having a first dipole element and a second dipole element positioned orthogonal to each other. Each crossed dipole pair can be positioned along the conductive surface of ground plane and within a vertical plane of the antenna to form a linear array. The cross dipole pairs, in combination with the ground plane, can exhibit rotationally symmetric radiation patterns in response to a linearly polarized electromagnetic signal having any orientation.

For example, the polarization states of a crossed dipole pair can be a slant left polarization state and a slant right polarization state. These polarization states are orthogonal, thereby minimizing the cross-polarization response of any electromagnetic signal received by the antenna. The polarization states can be maintained for a wide coverage area (half power beamwidth) of at least 45 degrees in an azimuth plane of the antenna.

For one aspect of the present invention, the BFN comprises a distribution network having a first power divider connected to each first radiating element having a first polarization state and another distribution network having a second power divider connected to each second radiating element having a second polarization state. Each distribution network, which is connected between the radiating elements and the PCN, can be viewed as a "corporate" distribution network of power dividers.

The BFN can be implemented in microstrip form as a printed circuit board (PCB), typically a multi-layer construction, having an etched top element containing the power divider circuits and a rear or bottom element having a predominately non-etched conductive surface. The conductive rear surface of the PCB provides a continuous ground plane of reasonable extent for the microstrip circuitry on the top surface, and offers a ground potential for the power divider circuits. A transfer adhesive barrier, comprising a dielectric material, can be used to attach the rear element of the PCB to the conductive ground plane, thereby forming a capacitive junction that operates to suppress passive intermodulation by preventing a direct current connection between the pair of conductive surfaces. Machined slots are positioned along the PCB at appropriate spaced-apart locations to support the mounting of radiating elements for connection to the power divider circuits. The machined slots offer an accurate locating mechanism for placement of the radiating elements because each radiating element can be inserted into a corresponding machined slot for mounting to the PCB. Electrical connections from the top element to the bottom element of the PCB are supported by plated-through holes, also called viaducts, on the PCB. In particular, an array of plated-through holes are positioned at each of the machined slots to provide ground potential connections for the radiating elements. Each array of plated-through holes serves to boost current carrying capability and to reduce RF impedance for the current path. The perimeter edges of the PCB and the machined slots are relieved to remove any metal burs that might otherwise be present as a result of the manufacturing process. This removal of any metal surfaces at the outer edges of the PCB and at the machined slots further supports the suppression of passive intermodulation by eliminating possible metal-to-metal connections within the antenna assembly.

This integrated implementation of the BFN can be assembled in an efficient manner by applying the solder mask and paste at desired solder locations on the PCB, inserting the radiating elements within the machined holes, and passing the entire assembly through a reflow oven to achieve the desired solder connections for each distribution network in a one-pass heating operation. Alternatively, the dielectric plate, implemented by the adhesive transfer barrier, can be attached to the radio-electric ground plane of the antenna tray and the rear conductive surface of the PCB is mounted to the ground plane via the adhesive transfer barrier. In turn, the solder mask and paste can be applied to the PCB, and the radiating elements inserted within the machined holes of the PCB. A localized heating source, such as a focused infrared, hot air source or specialized laser, can be used to apply heat to the areas on the PCB requiring solder connections.

A PCN, which is connected to the distribution network, can be used to control the polarization states of the received signals distributed via the distribution network by the radiating elements. The PCN, which is an optional mechanism for controlling polarization states, can include a pair of duplexers, specifically a first duplexer and a second duplexer, and a power combiner. The first duplexer is connected to the first power divider and has a first receive port and a first transmit port. The second duplexer is connected to the second power divider and has a second receive port and a second transmit port. Responsive to electromagnetic signals received by the radiating elements, the first and second receive ports output receive signals. The first and second transmit ports, which are connected to the power combiner, accept a transmit signal.

For another aspect of the present invention, the PCN can include a 0 degree/180 degree "rat race"-type hybrid coupler connected to the first and second receive ports of the duplexers. For example, if the antenna includes an array of crossed dipole pairs having slant left and slant right polarization states, the hybrid coupler can accept the receive signals from the duplexer receive ports and can output a receive signal having a vertical linear polarization state. The hybrid coupler also can accept these receive signals and, in turn, output a receive signal having a horizontal linear polarization state.

Alternatively, the PCN can comprise a 0 degree/90 degree quadrature-type hybrid coupler connected to the first and second receive ports of the duplexers. For an antenna including an array of crossed dipole pairs having slant left and slant right polarization states, the hybrid coupler can accept the receive signals from the duplexer receive ports and can output a receive signal having a left-hand circular polarization state. The hybrid coupler also can accept the receive signals and, in turn, output a receive signal having a right-hand circular polarization state.

As suggested above, flexibility in the choice of the polarization pair is determined by a relatively few component changes in the PCN. It will be appreciated that the PCN of the present invention includes significantly fewer components than the number of array elements in cases for which the number of array elements is greater than two. Hence, the antenna configuration and detailed implementation can be largely the same for a given design with the flexibility to select the polarization by few component changes. This feature is important for high volume manufacturing because the application of polarization diversity may demand different polarization pairs based on the communication system application, the type of diversity combiner, and the type of environment (e.g., rural, suburban, urban, in-building, etc.). The PCN also facilitates the ability to use the antenna in a full duplex mode of operation for both transmit and receive modes in the event that the transmit polarization state may be different than the dual receive polarization states.

The ground plane can be implemented as a solid conductive surface having major and minor dimensions corresponding to the array dimensions. Alternatively, the ground plane can comprise a solid conductive surface and a non-solid conductive surface. The solid conductive surface has a transverse extent dimension sufficient to achieve the desired polarization state for a vertical polarization component. In contrast, the non-solid conductive surface comprises a pair of parallel, spaced-apart conductive elements aligned within the horizontal plane of the antenna and symmetrically positioned along each transverse extent of the solid conductive surface. The transverse extent dimension of the solid conductive surface is approximately one wavelength for a selected center frequency, and each of the grid elements is spaced-apart (center-to-center) by approximately ⅓ to ½ of a wavelength for the selected center frequency.

The ground plane also can be implemented as a substantially planar sheet comprising a conductive material. Alternatively, the ground plane can be implemented as a substantially non-level, continuously curved sheet of conductive material or as a piece-wise curved implementation comprising conductive material.

A pair of spaced-apart side walls can be placed along the ground plane and parallel to the BFN to reduce the half-power azimuth beamwidth of the antenna. The radiating elements are centrally positioned between the side walls, which typically comprise a conductive material, and above the conductive surface of the ground plane. Specifically, each side wall, which can be attached to the radio-electric ground plane of the antenna tray, is spaced an equal distance from an axis extending along the major dimension of the antenna and connecting each center point of the array of radiating elements. In this manner, the side walls operate in tandem with the ground plane to form a conductive channel or cavity, which can be readily manufactured as a single component by an extrusion process. Alternatively, the side walls may be manufactured as separate sheet-metal construction parts and attached to the radioelectric ground plane via a transfer adhesive comprising dielectric material to avoid metal-to-metal contact. The height and separation of the side walls, in combination with the conductive surface of the ground plane, influence the shaping of the azimuth beamwidth for an antenna having certain radiating elements. For this aspect, it will be understood that the radiating element geometry, the ground plane, and the side walls operate in tandem to determine the radiation pattern in the azimuth plane. In contrast, the distribution network determines the radiation pattern in the elevation plane. Also, the radiating elements and the ground plane, in combination with an optional PCN, determine the polarization characteristics of the antenna.

Although a typical implementation to reduce the HPBW in the azimuth plane is the placement of spaced-apart, parallel side walls of solid conductive material on either side of the radiating elements placed on the BFN, it will be appreciated that alternative implementations include (1) spaced-apart, outwardly angled side walls or (2) parallel, non-solid side walls. The base of each angled side wall, which can be attached to the radio-electric ground plane of the antenna tray, is spaced an equal distance from an axis extending along the major dimension of the antenna and connecting each center point of the array of radiating elements. Likewise, the top of each angled side wall is separated from the radiating elements by a second larger spacing that is equal distance from the referenced axis connecting each center point of the array of radiating elements. The angle for the slope of each outwardly angled side wall, as viewed from base to top, can be within a range of 30 to 90 degrees, as measured from the ground plane. The non-solid side walls are similar to the parallel side walls design described above, with the exception that the conductive wall surfaces contain spacing or gaps. These gaps can be spaced along a wall at either a periodic interval or at irregular intervals. A typical spacing interval between gaps is approximately ⅓ to ½ of a wavelength for the selected center frequency.

In view of the foregoing, it will be appreciated that the present invention and its various embodiments will be more fully understood from the detailed description below, when read in connection with the accompanying drawings, and in view of the appended claims.

BRIEF DESCRIPTION OF THE DRAWINGS

FIGS. 4A, 4B, and 4C, collectively described as FIG. 4, are illustrations respectively showing a top view, side view, and rear view of a distribution network for a beam forming network for embodiments of the present invention shown in FIGS. 2A–2B and 3A–3B.

DETAILED DESCRIPTION

Figure 1:
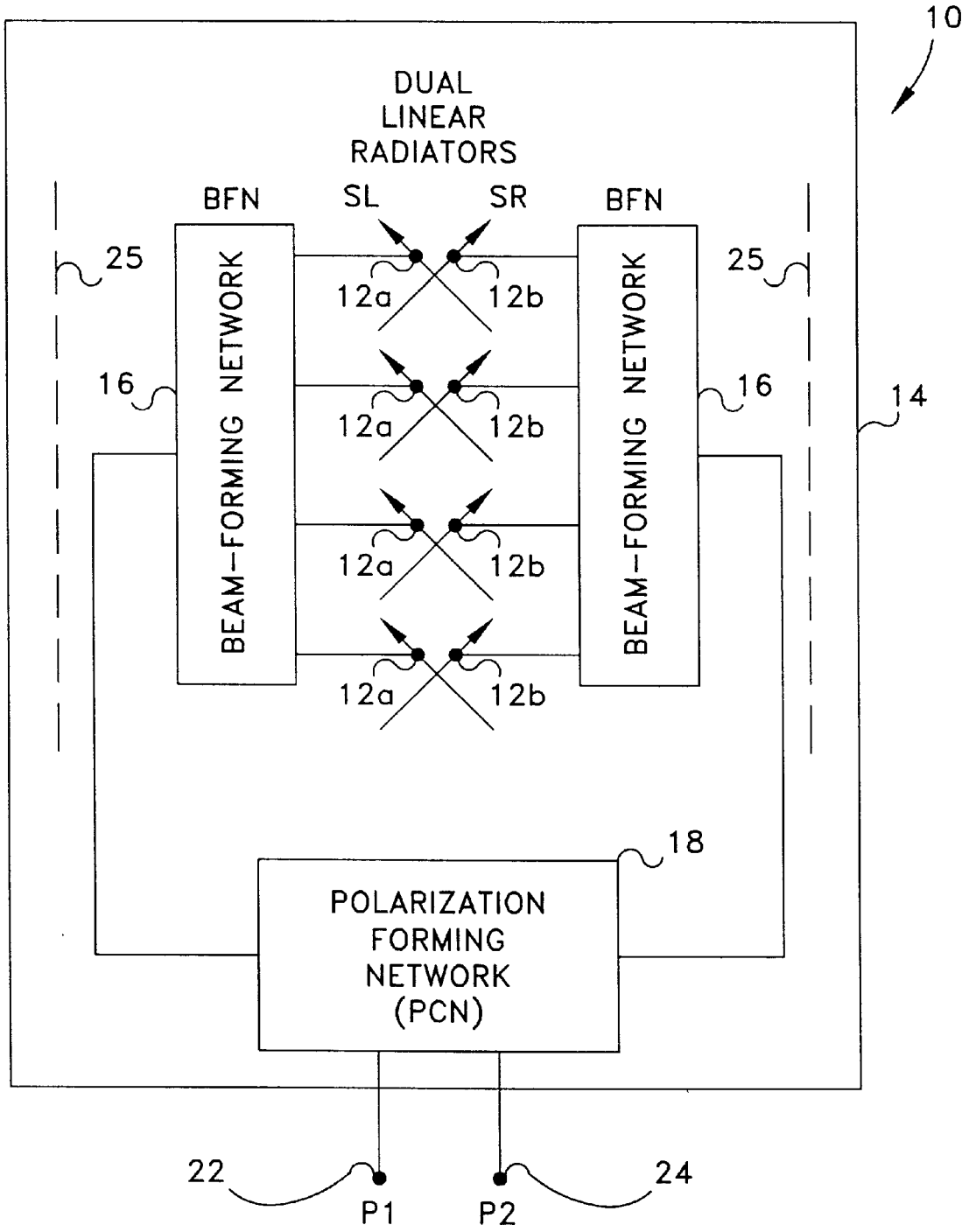
FIG. 1 is a block diagram illustrating the primary components of an exemplary embodiment of the present invention.

The antenna of the present innovation is useful for wireless communications applications, such as Personal Communications Services (PCS) and cellular mobile radiotelephone (CMR) service. The antenna uses polarization diversity to mitigate the deleterious effects of fading and cancellation resulting from a complex propagation environment. The antenna includes an array of dual polarized radiating elements and a beam-forming network (BFN) consisting of a power divider network for array excitation. In combination with the radiating elements, a conductive surface operative as a radio-electric ground plane supports the generation of substantially rotationally symmetric patterns over a wide field of view for the antenna.

Those skilled in the art will appreciate that poor antenna polarization performance characteristics can limit the available communications system power transfer. Prior to discussing the embodiments of the antenna provided by the present invention, it will be useful to review the salient features of an antenna exhibiting dual polarization characteristics.

In general, the far-field of an antenna can be represented by a Fourier expansion in a standard spherical coordinate system as:

$$E_\Theta=\Sigma_m[A_m(\Theta)\sin(\Phi)+B_m(\Theta)\cos(\Phi)]$$

$$E_\Phi=\Sigma_m[C_m(\Theta)\sin(\Phi)+D_m(\Theta)\cos(\Phi)]$$

where $E_\Theta$ and $E_\Phi$ are the component of the electric field in the $\Theta$ and $\Phi$ directions of a standard spherical coordinate system. Unit vectors $u_x$, $u_y$, and $u_z$, are aligned with the x, y, and z axis of the corresponding Cartesian coordinate system with the same origin.

In general, the coefficients are complex numbers to encompass all varieties of polarizations and angular phase distributions. The group phase and spreading factor common to both field components is omitted for the purposes here. If the beam possesses 'pseudo-circular symmetry' then the field may be accurately represented with a single expansion term (m=1). For a $u_y$ directed electric field (E-field) on boresight, the 'pseudo-circular symmetry' field representation is:

$$E_1(\Theta,\Phi)=f_1(\Theta)\sin(\Phi)u_\Theta+f_2(\Theta)\cos(\Phi)u_\Phi$$

where $f_1(\Theta)$ and $f_2(\Theta)$ are the principal plane normalized field pattern cuts and the variation is described by first order cosine and sine harmonics. Unit vectors $u_\Theta$ and $u_\Phi$ are in the direction of $\Theta$ and $\Phi$, respectively. The above form assumes a standard spherical coordinate system, with the plane of the electric field (E-plane) defined by $\Phi=90°$ and the plane of the magnetic field (H-plane) defined by $\Phi=0°$. The representation for a $u_x$ directed E-field on boresight is:

$$E_2=f_3(\Theta)\cos(\Phi)u_\Theta-f_4(\Theta)\sin(\Phi)u_\Phi$$

The condition for orthogonality between the two polarization components is:

$$E_1(\Theta,\Phi)\bullet E_2^*(\Theta,\Phi)=0$$

where • denotes the inner product and * denotes the complex conjugate. From which it follows:

$$[f_1(\Theta)f_3^*(\Theta) - f_2(\Theta)f_4^*(\Theta)]\frac{1}{2}\sin(2\Phi) = 0$$

Hence, orthogonality can only be achieved irrespective of the look angle if:

$$f_1(\Theta)f_3^*(\Theta)-f_2(\Theta)f_4^*(\Theta)=0$$

At $\Theta=0°$, the normalized field components are unity and the orthogonality condition is satisfied. Away from boresight, there are a number of individual conditions for principal plane pattern characteristics of the two basis polarizations which will satisfy the orthogonality condition. In general, the product of the E-plane patterns must equal the product of the H-plane patterns for the two basis polarizations at each value of $\Theta$. If the problem is further simplified by assuming the patterns have equal phase distributions, the only remaining condition to satisfy orthogonality is the patterns must be circularly symmetric. The degree of orthogonality will degrade from the ideal as pattern symmetry degrades.

The substitution $\Theta-\Theta_o\rightarrow\Theta$ in the field equations facilitates polarization rotation from alignment with the x-y axis of a Cartesian coordinate system at the antenna boresight to the axis coinciding with $\Phi=\pm\Phi_o$ Dual slant linear (slant left, slant right) polarizations are formed with $\Phi_o=45°$. Choosing the definition of slant left (SL) as the rotated $u_y$ directed E-field on boresight and slant right (SR) as the rotated $u_x$ directed E-field on boresight as viewed looking in the +z direction, the field representations are:

$$\underline{E}_{SL}(\Theta,\Phi) = \frac{1}{\sqrt{2}}f_1(\Theta)[\sin(\Phi)-\cos(\Phi)]\underline{u}_\Theta + \frac{1}{\sqrt{2}}f_2(\Theta)[\cos(\Phi)+\sin(\Phi)]\underline{u}_\Phi$$

$$\underline{E}_{SR}(\Theta,\Phi) = \frac{1}{\sqrt{2}}f_3(\Theta)[\cos(\Phi)+\sin(\Phi)]\underline{u}_\Theta - \frac{1}{\sqrt{2}}f_4(\Theta)[\sin(\Phi)-\cos(\Phi)]\underline{u}_\Phi$$

Definition 3 of A. C. Ludwig, "The Definition of Cross Polarization," *IEEE Trans. Antennas Propagat.*, vol. AP-21, pp. 116–119, January 1973 is used herein for the definition of "cross polarization". Definition 3 describes the field contours of a theoretical elemental radiator known as a Huygens source. The Huygens source is a combination of an electric dipole and a magnetic dipole of equal intensity and crossly oriented. The Huygens source is unique among all admixtures of electric and magnetic dipoles in that when it is rotated 90° about its boresight axis ($u_z$) the fields produced are (at all look angles) exactly orthogonal to those produced by the un-rotated source. Hence, if two Huygens sources (oriented exactly 90° in $\Phi$ with respect to each other in a standard spherical coordinate system) are chosen as two radiating elements for a dual polarized antenna, they will provide a pair of basis polarizations which are always orthogonal (irrespective of look angle). Consequently, the polarization produced when the two orthogonal radiators are excited with a given amplitude and phase weighting may vary only in tilt angle as a function of and relative to the synthesized boresight polarization.

The characteristics of a Huygens source is one of the characteristics desired of an orthogonal radiator for the polarization diversity application. It would, of course, be desirable that the tilt angle also remain invariant; however, it is difficult to define what invariance of tilt angle is due to difficulties of establishing definitions of polarization. Polarization orthogonality is the primary concern in providing optimum polarization coverage performance since the communications link depends only on a single polarization to any user. Several desirable pattern features are attendant with the conditions for optimum antenna polarization performance.

For the purpose of describing the key features of the preferred embodiment of the present inventions, an array of radiating elements is taken along the y-axis of a standard Cartesian coordinate system and lies in the x-y plane. The elevation plane of the array is defined as the plane passing through the beam peak and along the y-axis. The azimuth plane is transverse to elevation and the principal plane pattern cut is through the beam peak.

If the mutual element coupling is sufficiently low in the array, then the pattern requirements for optimum polarization coverage can be applied to a radiating element alone. The field due to an array of Huygens sources has the same polarization as that of a single Huygens source. However, the radiation pattern is different. The array factor has no polarization properties since it is the pattern of an array of isotropic radiators. This is of importance in the present invention because the radiation pattern intensity in the elevation plane can be primarily controlled by the array geometry, whereas the polarization of the radiated wave is completely established by the choice of array element as are the pattern features in the azimuth plane.

For a linear array, the preferred orientation of element polarizations is slant (±45°) relative to the array (y-axis) in order to achieve the best balance in the element pattern symmetry in the presence of mutual coupling between array elements. The boundary conditions of a finite radio-electric ground plane aligned along the major and minor axis of the array are the same for the two crossly oriented element polarizations when the element is centered on the ground plane.

The unit vector definitions of the reference (co-polarized) and cross-polarized fields for a $u_y$ directed E-field on boresight are using definition 3 are:

$$e_{ref}(\Theta,\Phi)=\sin(\Phi)u_\Theta+\cos(\Phi)u_{101}$$

$$e_{cross}(\Theta,\Phi)=\cos(\Phi)u_\Theta-\sin(\Phi)u_\Phi$$

and for a $u_x$ directed E-field on boresight are:

$$e_{ref}(\Theta,\Phi)=\cos(\Phi)u_\Theta-\sin(\Phi)u_\Phi$$

$$e_{cross}(\Theta,\Phi)=\sin(\Phi)u_\Theta+\cos(\Phi)u_\Phi$$

For SL and SR polarizations, the reference and cross-polarized unit vector definitions may be obtained in a like manner as before by substitution for $\Phi$ effecting a rotation of 45°.

Several features of the antenna provided by the present invention are illustrated by considering the pattern polarization characteristics in the $\Phi=0°$ azimuth plane of the array with dual slant element characteristic polarizations. First, the electric field distribution may be written in terms of the reference and cross-polarized components as:

$$\underline{E}_{SL}(\Theta,\Phi=0) = \frac{1}{2}[f_1(\Theta)+f_2(\Theta)]\underline{u}_{ref} + \frac{1}{2}[f_2(\Theta)-f_1(\Theta)]\underline{u}_{cross}$$

$$\underline{E}_{SR}(\Theta,\Phi=0) = \frac{1}{2}[f_3(\Theta)+f_4(\Theta)]\underline{u}_{ref} + \frac{1}{2}[f_4(\Theta)-f_3(\Theta)]\underline{u}_{cross}$$

The cross-polarization pattern constitutes one-half the difference of the principal (E- and H-plane) patterns of the radiating element. Zero cross-polarization implies complete rotational symmetry of the co-polarized pattern. Zero cross-polarization corresponds to orthogonality for the dual polarized source.

Further, the inner product of the slant polarized field with the reference polarization for a $u_y$ directed E-field on boresight results in the pattern which is a multiplying factor of one-half the normalized co-polarized H-plane pattern of the radiating element. The inner product of the slant polarized field with the reference polarization for a $u_x$ directed E-field on boresight results in the pattern which is multiplying factor of one-half the normalized co-polarized E-plane pattern of the radiating element. The coverage in the azimuth plane will be the same, separate from a constant factor of one-half only if the radiator element pattern has complete rotational symmetry. The feature of the same pattern distribution, apart from the constant factor, is considered an important feature of an antenna for use in a communication system using polarization diversity. Otherwise, the amplitude difference in the polarization coupling of a linearly polarized signal to the linearly polarized antenna is greater than the ideal polarization mismatch factor for misalignments up to 45° resulting in sub-optimum polarization diversity performance. This reduction in polarization coupling is a consequence of the degree of orthogonality where the coupling is reduced relative to the ideal case when polarization orthogonality exists.

An additional feature of a rotationally symmetric radiation pattern is that the azimuth pattern characteristic of the array will remain invariant when the two beams corresponding to dual polarized element characteristic polarizations are weighted together to form a polarization pair differing from the natural element polarizations. This capability is considered an interesting field of application of the proposed invention. Although the examples used to illustrate the key polarization features are for linear polarizations, the same holds true for other orthogonal polarization pairs. The use of dual circular polarization (right hand, left hand senses) is believed to also be applicable to wireless communication systems using polarization diversity.

Turning now to the drawings, in which like reference numbers refer to like elements, FIG. 1 is a block diagram illustrating the primary components of the preferred embodiment of the present invention. Referring to FIG. 1, an antenna 10 is shown for communicating electromagnetic signals with the high frequency spectrums associated with conventional wireless communications system. The antenna 10 can be implemented as a planar array of radiator elements 12, known as wave generators or radiators, wherein the array is aligned along a vertical plane of the antenna as viewed normal to the antenna site. For the preferred linear array implementation, the array factor predominately forms the elevation coverage and the azimuth coverage is predominately influenced by the element pattern characteristics when no downtilt (mechanical or electrical) is applied. In general, this linear array may be categorized as a fan-beam antenna producing a major lobe whose transverse cross section has a large ratio of major to minor dimensions.

The antenna 10, which can transmit and receive electromagnetic signals, includes radiating elements 12, a ground plane 14, and a beam-forming network (BFN) 16. The radiating elements 12, which comprise elements 12*a* and 12*b* exhibiting dual polarization states, are wave generators preferably aligned in a linear array and positioned at a predetermined distance above a conductive surface of the ground plane 14. The radiating element 12 and the ground plane 14 operate in tandem to provide the desired pattern characteristics for the antenna 10. The antenna 10 exhibits a substantially rotationally symmetric radiation pattern which, for the purposes of this specification, is defined as a co-polarized pattern response having "pseudo-circular symmetry" properties and principal (E- and H-) plane patterns that are different by no more than approximately 3.1 dB at any value of theta over the field of view for the antenna. Alternatively, a substantially rotationally symmetric radiation pattern can be viewed as a co-polarized pattern response having "pseudo-circular symmetry" properties and a cross-polarization ratio less than approximately −15 dB within the field of view for the antenna. For the preferred implementation of the antenna 10, a linear array of dual polarized radiating elements exhibits a rotationally symmetric radiation pattern for a wide field of view, typically for a half power beamwidth (HPBW) selected from the range of 45 to 120 degrees. The BFN 16, which operates as a distribution network, is connected to the radiating elements 12*a* and 12*b* for transporting receive signals from the radiating elements and transmit signals to the radiating elements.

To reduce the half-power azimuth beamwidth, if desirable for a selected application, a pair of spaced-apart side walls 24 can be placed on each side of the planar array of radiating elements 12*a* and 12*b*. The side walls 24, which comprise conductive material, are connected to the ground plane 14, thereby forming an open-faced cavity or channel surrounding the radiating elements 12*a* and 12*b*. The cross sectional geometry of the side walls 24, namely height and separation distance, coupled with the ground plane characteristics and the radiator geometry, affects the shaping of the azimuth beamwidth. For an exemplary embodiment, the side walls 24 are mounted perpendicular to the ground plane 14 and parallel to the radiating elements 12 and 12*b*. Other embodiments of the antenna can employ side walls that are angled outward away from the radiating elements, thereby producing a flared section, as will be described in more detail below with respect to FIG. 19. Although the exemplary embodiment described below with respect to FIG. 2A employs side walls comprising continuous, spaced apart sections of conductive material extending along the length of a linear array of radiating elements, the side walls also can comprise non-solid sections of conductive material having gaps or spacing between solid conductive surfaces, as shown below with respect to FIG. 20.

Because the antenna 10 is generally intended for operation with PCS and CMR applications, those skilled in the art will appreciate that the radiating elements 12 are preferably characterized by generally high efficiencies, broad radiation patterns, high polarization purity, and sufficient operating bandwidths. In addition, it is desirable that the radiating elements 12 be lightweight and low in cost, interface directly with the BFN 16, and be integrated with the antenna packaging. Dipole antennas satisfy all of these electrical performance requirements, and a printed implementation fulfills the physical criteria. As will be described in more detail below with respect to FIG. 6, the preferred implementation of each radiator 12*a* and 12*b* is a dipole-type antenna exhibiting the polarization states of slant left (SL) and slant right (SR).

A polarization control network (PCN) 18, which is centrally connected to the array via the BFN 16, can provide a mechanism for control of the polarization states. The PCN 18, which is an optional control mechanism connected to the BFN 16, can control the polarization state of receive signals distributed by each distribution network. Because the radiating elements 12 exhibit dual polarization states, the PCN 18 can accept receive signals having either of two polarization states, and can output electromagnetic signals having a polarization state P1 at a first output port 20 and electromagnetic signals having a polarization state P2 at a second output port 22.

Figure 2A:
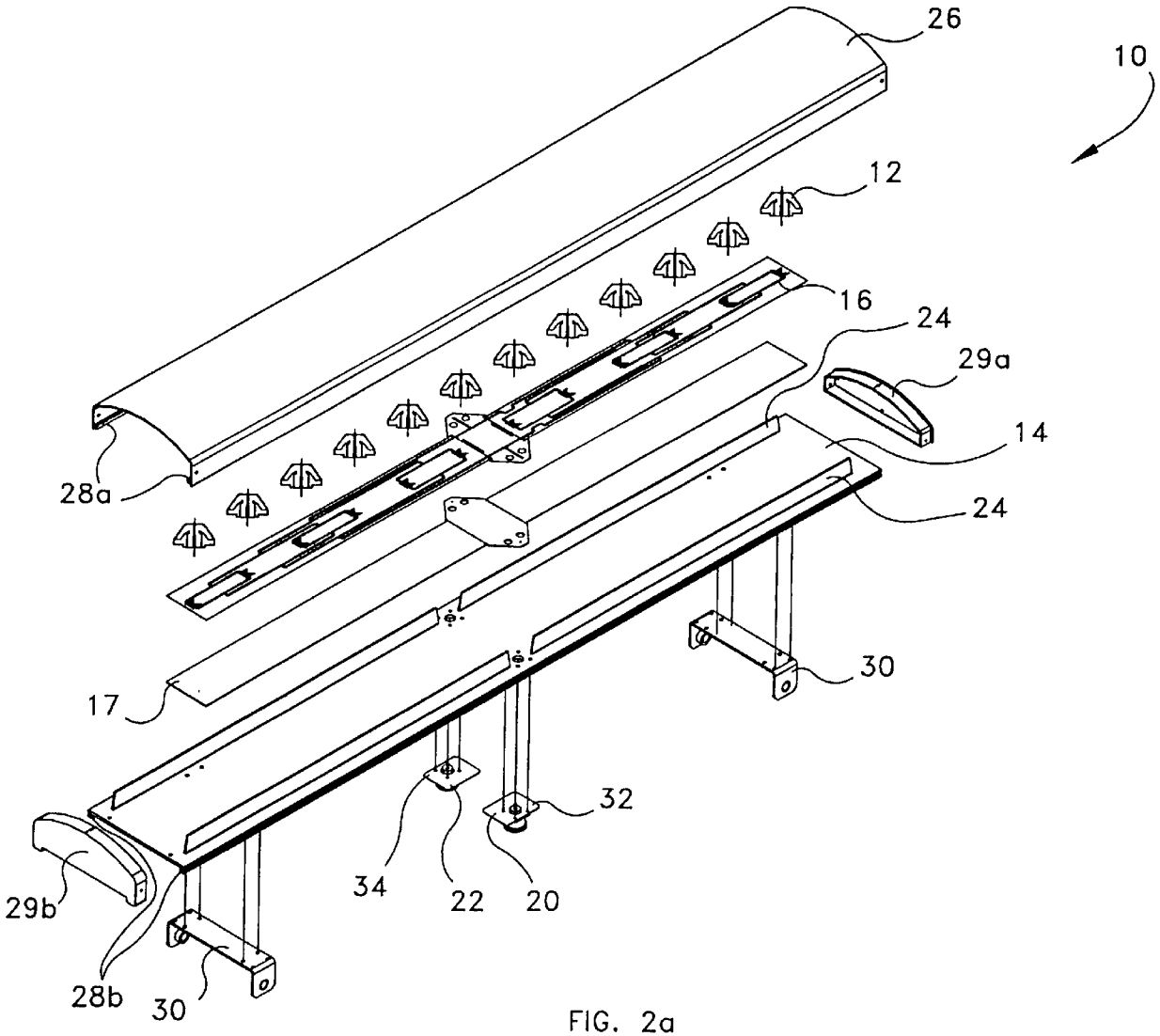
FIG. 2A is an illustration showing an exploded representation of the construction of an exemplary embodiment of the present invention.
Figure 2B:
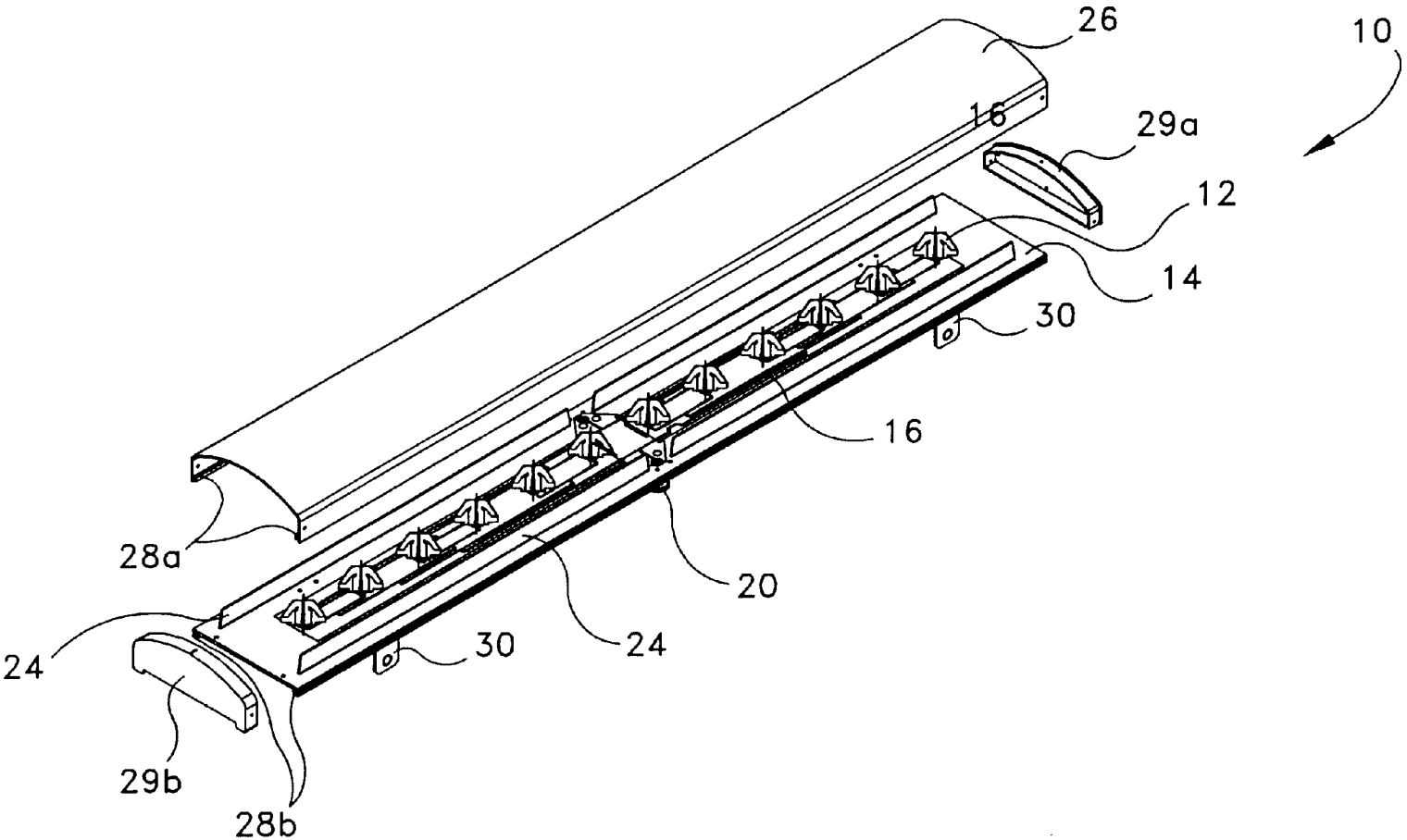
FIG. 2B is an illustration showing an elevation view of the exemplary embodiment shown in FIG. 2A.
Figure 3A:
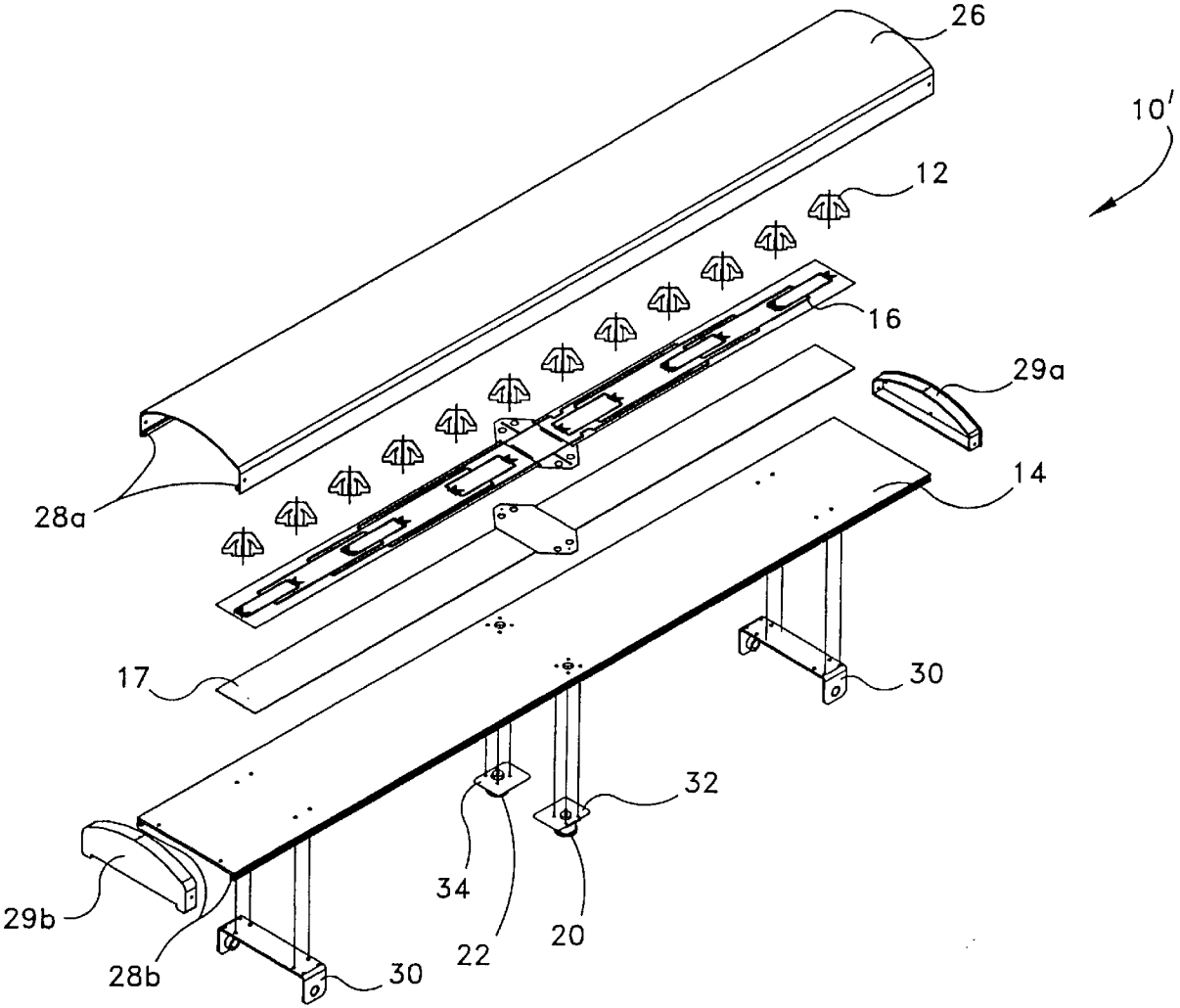
FIG. 3A is an illustration showing an exploded view of an alternative embodiment of the present invention.
Figure 3B:
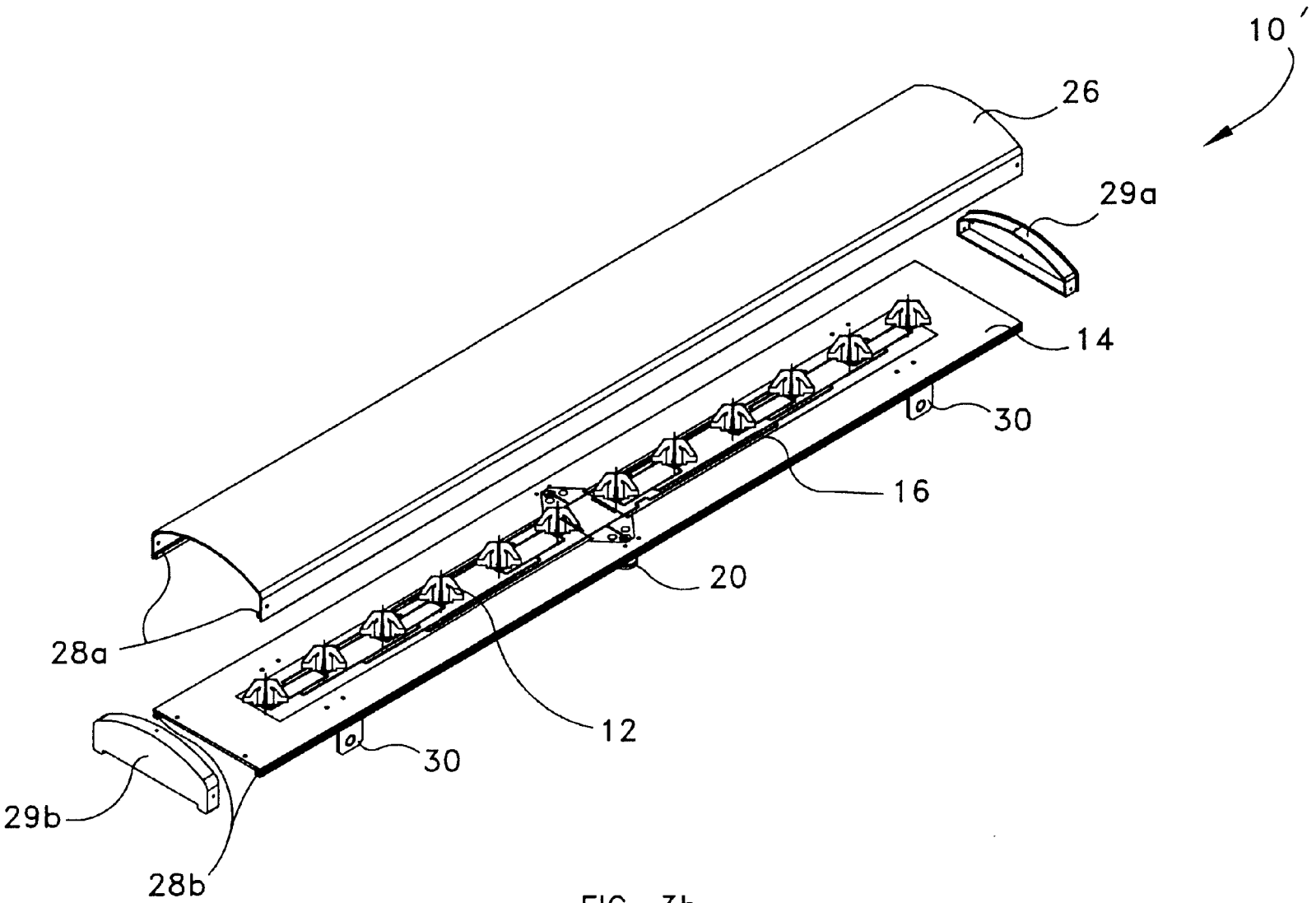
FIG. 3B is an illustration showing an elevation view of the alternative embodiment shown in FIG. 3A.

FIGS. 2A and 2B are illustrations respectively showing an exploded representation of the primary components of the antenna 10 and an elevation view to highlight an exemplary construction of the antenna. FIGS. 3A and 3B are illustrations respectively showing an exploded representation of the primary components of another embodiment of antenna 10' and an elevation view to show the alternative construction of the antenna. The implementation illustrated in FIGS. 2A–2B is for an antenna design having a 65° half-power azimuth beamwidth, whereas the implementation shown in FIGS. 3A–3B is for an antenna design having a 90° half-power azimuth beamwidth. Both illustrated designs, however, can exhibit the desirable characteristic of a substantially rotationally symmetric radiation pattern characteristic in the forward direction above the ground plane of the antenna.

Referring first to FIGS. 2A and 2B, collectively described as FIG. 2, each radiating element 12 preferably comprises two dipole antennas, each having a pair of dipole arms and a dipole base, co-located to form a crossed-dipole pair. The crossed-dipole pair have co-located electric centers, thereby minimizing any phase delay associated with feeding these dipole antennas. Each crossed-dipole pair is positioned parallel to and above the front conductive surface of a radio-electric ground plane provided by the ground plane 14. Specifically, the crossed dipole pair is inserted into machined slots, which are placed along the BFN 16 at periodically spaced intervals along a central axis extending along the major dimension of the BFN. A rear conductive surface of the BFN 16 is attached to the ground plane 14 via a dielectric plate 17, thereby forming a capacitive junction of conductive surfaces separated by a dielectric material. The crossed-dipole pair is oriented such that the supply for a dipole is located at the dipole base and the vertex of the dipole arms represents the largest distance of separation from the ground plane for any point on the dipole. The dipole arms are swept down towards the ground plane 14 in an inverted "V"-shape. The height of the dipole arms above the surface of the ground plane 14 and the angle of the dipole arms can be optimized to provide a substantially rotationally symmetric radiation pattern characteristic in the forward direction above the ground plane 14. The preferred dimensions of the dipole antenna and its feed line are described in detail below with respect to FIG. 9 for an antenna design having a 65° half-power azimuth beamwidth, as shown in FIGS. 2A–2B, and an antenna design having a 90° half-power azimuth beamwidth, as shown in FIGS. 3A–3B.

The BFN 16 distributes electromagnetic signals to and from the dipole antennas of the radiating elements 12. For the embodiment shown in FIGS. 2A–2B (and 3A–3B), the BFN 16 uses an overall distribution network or feed network comprising a pair of distribution networks for the dual polarized array assembly, one for each polarization state. The BFN 16, which is preferably implemented as a microstrip transmission design, operates as a "corporate" feed network and supplies an appropriate impedance match for each radiating element 12. As will be described in more detail below with respect to FIGS. 4A–4C and FIG. 5, the BFN 16 can comprise a pair of centrally-connected distribution networks, each having a sequence of power dividers and implemented as a printed circuit board (PCB) having one or more layers. A pair of antenna ports 20 and 22, each of which can be connected to a feed cable, are typically positioned at the center portion on the tray of the antenna assembly and provide a signal interface to the BFN 16.

For a PCB-implemented BFN, the top face includes an etched surface forming the microstrip circuits for the distribution networks, and the bottom face, which is substantially parallel to the top face, includes a conductive surface operative as a radio-electric ground plane. To avoid a direct current contact between the ground plane 14 and the rear surface of the PCB, a dielectric plate 17 is positioned between these conductive surfaces, thereby forming a capacitive junction. In this manner, the BFN 16 (and each radiating element 12 ) lies above and parallel to the conductive surface of the ground plane 14. Significantly, passive intermodulation effects can be suppressed by positioning a dielectric material of the dielectric plate 17 between the corresponding portions of the ground plane 14 and the BFN 16, as will be described in more detail below.

The conductive rear surface on the bottom face of the PCB-implementation of the BFN 16 has sufficient conductive surface area to provide a low impedance path at the frequency band of operation. The relatively thin dielectric layer, provided by the dielectric plate 17, supports the dual functions of providing a direct current (DC) barrier and operating as a double-sided adhesive for mechanically restraining the position of the crossed-dipole pair assembly on the ground plane 14. The dielectric plate 17 prevents a direct metal-to-metal junction contact, which is considered a potential source of passive intermodulation frequency products during operation at high radio power level, such as several hundred Watts. The dielectric plate 17 is preferably implemented by a dielectric material supplied by a double-sided transfer adhesive known as Scotch VHB, which is marketed by 3M Corporation of St. Paul, Minn. For the preferred embodiment, the selected dielectric material is 0.002 inches thick and at least as wide as the rear conductive surface of the PCB, preferably trimmed to match the extent of the PCB.

The conductive surface of the ground plane 14 serves as a structural member for the overall antenna assembly, as well as a radio-electric ground plane for imaging the dipole elements. The ground plane is preferably implemented as a solid, substantially flat sheet of conductive material. The radio-electric extent of the ground plane 14 in the transverse plane of the antenna array (width) is approximately 5/3 wavelength to facilitate imaging the radiator elements over wide fields of view (typically greater than 45–60 degrees) without the finite boundary of the conducting ground plane 14 appreciably contributing to the radiation characteristics. When the radio-electric extent of the ground plane 14 satisfies the above criteria, the orientation of the radiating elements 12 may be rotated and aligned with the principal planes of the array without seriously degrading the rotational symmetry of the antenna radiation patterns. Nevertheless, the preferred and optimum orientation is when the natural boresight polarizations are 45° with respect to the principal planes of the array.

Empirically-derived data confirms that larger transverse dimensions cause no significant improvements of the rotational symmetry although generally leads to reduced power in the radiation pattern in the rearward direction. For some applications, a low level radiation pattern in the rear direction, termed backlobe region, is desirable and the degree of backlobe reduction is traded with the increased size, weight, cost, and wind loading characteristics.

Measurements conducted for a radio-electric ground plane having a smaller transverse dimension indicate that this smaller width without side walls can cause undesirable pattern beamwidth dispersion when the transverse extent is approximately 1.5 wavelength. Yet even smaller transverse extents of a ground plane can cause the azimuth beamwidth to become appreciably sensitive to the number of array elements. This disadvantage is accompanied by a divergence in the desired rotationally symmetrical radiation patterns.

Measurements have also demonstrated that the radio-electric extent of the ground plane 14 in the transverse plane of the array can be made significantly smaller than the above-specified criteria without the azimuth beamwidth being appreciably sensitive to the dimensions over a wide range of smaller values for the case of a vertically-oriented radiator, aligned with the plane of the array. However, this same independence cannot be accomplished for a horizontally polarized component (physical or synthesized via a PCN). Because the need for dual polarization states exists in this application, preferably with co-located electric centers, it is necessary that the size criteria be applied to both polarizations, where the conditions for the horizontal component is the determining factor.

The side walls 24, which are spaced-apart and placed on each side of the planar array of radiating elements 12*a* and 12*b*, operate in tandem with the radio-electric ground plane represented by the ground plane 14 and the geometry of the radiating elements 12, to shape the half-power azimuth beamwidth of the antenna 10. The side walls 24, which preferably comprise continuous sections of solid, conductive material, are connected to the ground plane 14 to form an open-faced cavity or channel that extends along the array of radiators 12 and adjacent to the BFN 16. For the illustrated embodiment, two pairs of side walls 24 are mounted perpendicular to the ground plane 14 and extend parallel to the centrally-located linear array of radiating elements 12. Each side wall 24 within an aligned, spaced-apart pair are separated by a central spacing at a junction formed by the pair of the distribution networks for the BFN 16 and adjacent to the antenna ports 20 and 22.

The placement of the side walls 24 along the ground plane 14 and adjacent to the radiators 12 is symmetrical, and the distance separating a radiating element from a side wall is equal to the distance separating the radiating element from the corresponding side wall. The cross section geometry of the side walls 24, including the distance spanning the spacing between the side walls and the height of the side wall, contributes to the shaping of the azimuth beamwidth. For example, for the illustrated embodiment employing crossed-pair of dipole radiators, an increase in the height of the side walls tends to narrow the azimuth beamwidth. In contrast, the azimuth beamwidth tends to spread in response to moving the side walls apart and away from the distribution network, while maintaining a fixed height for the walls. Advantageously, the combination of the ground plane 14 and the spaced-apart side walls 24 can be efficiently manufactured as a one-piece assembly by an extrusion process.

For the 65 ° azimuth HPBW antenna design shown in FIGS. 2A–2B, the distance spanning the separation of the parallel, spaced apart side walls 24 is approximately 0.95 wavelength ($\lambda_o$) at the center operating frequency. The height of each side wall 24, extending from the base of the side wall to its top edge, is approximately 0.19 wavelength ($\lambda_o$) at the center operating frequency.

The use of the side walls 24 to narrow the beamwidth in the azimuth plane allows the transverse extents of the radio-electric ground plane 14 to be narrower than a 5/3 wavelength criteria. The transverse extents of the 65° azimuth HPBW design, as shown in FIGS. 2A–2B, beyond the base of a side wall are not necessary to provide the circularly symmetric pattern properties. Measurements have demonstrated that the pattern characteristics in the forward direction corresponding to the coverage region is essentially unaffected by the presence or absence of the radio-electric ground plane beyond the base of the side walls. The presence of the radio-electric ground plane beyond the base of each side wall is used to allow a single radome design for both 90° and 65° azimuth HPBW antenna designs in the respective examples presented in FIGS. 2A–2B and FIGS. 3A–3B. A second justification is the ground plane beyond the base of the side walls reduces the backlobe radiation of the 65° azimuth HPBW design below the configuration without additional ground plane.

A protective radome 26 comprising a PVC material can be used to cover the combination of the array of radiating elements 12, the BFN 16, the PCN 18, the dielectric plate 17, the front conductive surface of the ground plane 14, and the side walls 24. The radome 26 preferably comprises a PVC material manufactured in the desired form by an extrusion process. The radome 26 is attached to spaced-apart edges extending along the major dimension of the ground plane 14 by a keyway mechanism and encompasses the front surface of the ground plane 14 and the elements mounted thereon. The keyway mechanism comprises a tongue 28*a* extending along the edge of each spaced-apart side of the radome 26 and a groove 28*b* formed along the length of each corresponding edge on the major dimension of the rear surface of the ground plane 14. A pair of end caps 29*a* and 29*b*, each positioned along the minor dimension at an end of the ground plane 14, covers the remaining openings formed at the ends of the combination of the ground plane 14 and the radome 26. Each end cap is attached to the edge periphery of the radome and the ground plane by mounting fasteners. The encapsulation of the antenna within a sealed enclosure formed by the ground plane 14, the radome 26, and the end caps 29*a* and 29*b* protects the antenna elements from environmental effects, such as direct sunlight, water, dust, dirt, and moisture. To permit moisture to drain from the interior of the antenna assembly, the end cap mounted at the bottom of the antenna preferably includes one or more dew holes.

Figure 6:
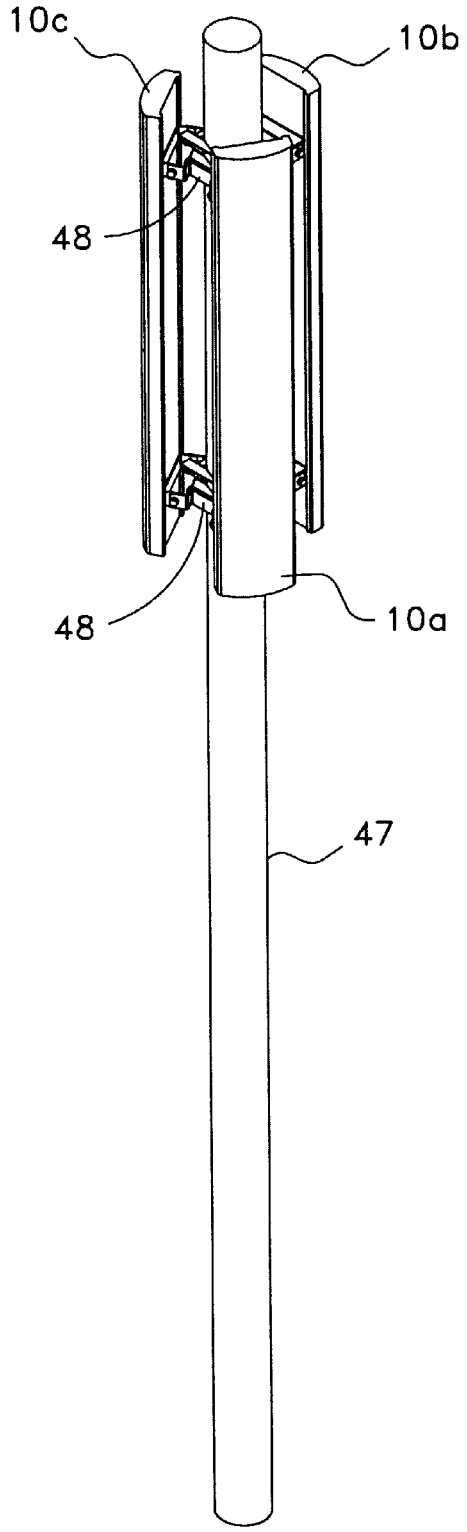
FIG. 6 is an illustration showing a typical mounting arrangement for an antenna provided by an exemplary embodiment of the present invention.

The antenna can be mounted to a mounting post via a pair brackets 30, which are attached to the rear conductive surface of the ground plane 14. Although the preferred mounting arrangement for the antenna 10 is via a single mounting post, it will be understood that a variety of other conventional mounting mechanisms can be used to support the antenna 10, including towers, buildings or other free-standing elements. A typical installation of the antenna 10 is shown in FIG. 6, which will be described in more detail below.

The antenna ports 20 and 22, which are preferably implemented as coaxial cable-compatible receptacles, such as N-type receptacles, are connected to the rear surface of the ground plane 14 via capacitive plates 32 and 34. Each capacitive plate 32 and 34 includes the combination of a conductive sheet and a dielectric layer positioned adjacent to and substantially along the extent of the conductive sheet. When mounted to the antenna assembly, the conductive sheet is positioned adjacent to the coaxial cable-compatible receptacle of each port 20 and 22, whereas the dielectic layer is sandwiched between the rear conductive surface of the ground plane 14 and the conductive sheet. In this manner, the radio-electric connection of the current path between the antenna ports 20 and 22 and the ground plane 14 is achieved via "capacitive coupling". The conductive sheet has sufficient area to provide a low impedance path at the frequency band of operation. The dielectric layer serves as a direct current (DC) barrier by preventing a direct metal-to-metal junction contact between the antenna ports 20 and 22 and the ground plane 14. This type of capacitive coupling, which is used to reduce passive intermodulation effects, is also implemented by the dielectric plate 17 that separates the rear conductive surface of the BFN 16 from the conductive surface of the ground plane 14. This technique for suppressing passive intermodulation is described in more detail within the specification of U.S. Pat. application Ser. No. 08/396,158, filed Feb. 27, 1995, which is owned by the assignee for the present application, and is hereby fully incorporated herein by reference.

For optional polarization control, a PCN (not shown) can be centrally located in the antenna assembly and connected between the distribution networks of the BFN 16 and the pair of antenna ports 20 and 22. The PCN distributes electromagnetic signals to and from the radiating elements 12 via the BFN 16 and provides a complex (both amplitude and phase) weighting of these signals. For the preferred embodiment, the PCN 18 is implemented as a polarization control mechanism having at least four external interfaces for connection to transmission lines. Two of the four external interfaces connect with the distribution networks of the BFNs 16, and the remaining two external interfaces connect with the antenna ports 20 and 22, which in turn are connected to feed cables for connecting a source to the antenna.

If the PCN is not installed within the assembly of the antenna 10, the distribution networks of the BFN 16 can supply an appropriate impedance match between the radiating elements 12 and each feed cable connected to antenna ports 20 and 22. For this implementation, each of the antenna ports 20 and 22 typically corresponds to one of the two polarization states, thereby suppressing signal reflections along this transmission line. Although the PCN is typically installed within the interior of the antenna assembly, it will be appreciated that the PCN also can be located outside of the antenna chassis. It will be understood that the PCN can be installed either within the assembly of the antenna 10 or outside of the antenna chassis based on the particular application for the antenna. For example, the PCN can be installed at the base receive site, whereas the combination of the radiating elements 12, ground plane 14, and BFN 16 can be installed within an antenna assembly at the antenna site.

Turning now to FIGS. 3A and 3B, which provide views of the construction of an alternative embodiment, an antenna 10', one will appreciate that the primary observable difference between the alternative antenna 10' of FIGS. 3A–3B and the antenna 10 shown in FIGS. 2A and 2B is the absence of the side walls along the ground plane of the antenna 10'. Because the antenna 10' is designed to generate a wider half-power azimuth beamwidth, nominally 90 degrees, there is no requirement to narrow the beamwidth by the placement of conductive spaced-apart side walls extending along each major dimension side of the linear array of radiating elements 12. With the exception of the side walls noted above, the components shown in FIGS. 3A and 3B of the antenna 10' are identical to the ones described above with respect to the antenna 10 of FIGS. 2A–2B.

The antennas shown in FIGS. 2A–2B and FIGS. 3A–3B are primarily intended to support communications operations within the Personal Communications Services (PCS) frequency range of 1850–1990 MHz. However, those skilled in the art will appreciate that the antenna dimensions can be "scaled" to support typical cellular telephone communications applications, preferably operating within the band of approximately 805–896 MHz. Likewise, the design of the antenna can be scaled to support European communications application, including operation within the Global System for Mobile Communications (GSM) frequency range of 870–960 MHz or the European PCS frequency range of 1710–1880 MHz. These frequency ranges represent examples of operating bands for the antenna; the present invention is not limited to these frequencies ranges, but can be extended to frequencies both below and above the frequency ranges associated with PCS applications.

Significantly, the antennas 10 and 10', respectively shown in FIGS. 2A–2B and FIGS. 3A–3B, each provide a planar array of radiating elements having dual polarization states and having substantially rotationally symmetric radiation patterns for a wide field of view. For example, the illustrated antenna 10 of FIGS. 2A–2B has a 60 degree HPBW within the azimuth plane, which is achieved by the combination of the dual-polarized radiators, the ground plane, and the side walls. Likewise, the illustrated antenna 10' of FIGS. 3A–3B has a 90 degree HPBW within the azimuth plane of the antenna, which is achieved by the combination of the dual-polarized radiators and the ground plane. In contrast, the half-power beamwidth for the elevation plane is predominately achieved by the size of the antenna array, i.e., the number of radiating elements within the planar array and the interelement spacing. It will be appreciated that the present invention is not limited to the specific embodiments described above, and that other embodiments of the present invention can exhibit an HPBW beamwidth in the azimuth plane of the antenna selected from a range between 45 degrees and 120 degrees.

FIGS. 4A, 4B, and 4C are illustrations of various views of the distribution network system of the BFN 16. The "corporate" distribution network system of the BFN 16 can be implemented in microstrip transmission form as a printed circuit board (PCB) 35. The PCB 35, typically having a multi-layer construction, comprises an etched top element 36 containing power divider circuits 37 and a bottom element 38 having a non-etched conductive surface 39. The conductive bottom element 38 of the PCB 35 provides a continuous radio-electric ground plane of reasonable extent for the microstrip circuitry on the top element 36, and offers a ground potential for the power divider circuits. Because the combination of power divider circuits 37 trace a continuous path along the top element 36, there is a need for a radio-electric ground plane placed beneath the microstrip transmission lines, which is provided by the conductive surface 39 on the bottom element 38. The rear conductive surface 39 preferably provides a radio-electric ground plane having dimensions that exceed the overall size of the microstrip transmission lines on the top element 36.

The dielectric plate 17, typically a two-sided adhesive barrier, is used to attach the PCB 35 to the antenna tray and to prevent a direct current connection between the conductive surface 39 of the bottom element 38 and the conductive surface of ground plane 14. As described above with respect to FIGS. 2A–2B, this capacitive junction supports the suppression of passive intermodulation effects by preventing direct metal-to-metal contact between the PCB 35 and the ground plane 14.

Likewise, the perimeter edges 40 of the PCB 35 itself are preferably relieved to remove any metal burs that might otherwise be present as a result of the manufacturing process. This removal of any unintended metal surfaces, such as metal burrs, at the outer edges of the PCB 35 further supports the suppression of passive intermodulation by eliminating possible metal-to-metal connections within the antenna assembly.

Machined slots 41 are positioned along the PCB at appropriate spaced-apart locations to support the mounting of radiating elements 12. Etched traces of the power divider circuits 37 terminate at the machines slots 41 for connection to each feed line of the radiating elements. Advantageously, the machined slots 41 offer an accurate locating mechanism for placement of the radiating elements because each radiating element can be inserted into a corresponding machined slot for mounting to the PCB. Indeed, the machined slots 41 can be viewed as an efficient mechanism for mounting a component to the PCB of the BFN 16. The perimeter edges of each machined slot 41 is preferably relieved to remove any metal burs that might otherwise be present as a result of the manufacturing process. Again, this further supports the suppression of passive intermodulation by eliminating possible metal-to-metal connections within the antenna assembly.

It will be understood that each machined slot 41 comprises a slot having sufficient length to accommodate the insertion of a radiating element. For the crossed dipole pair implementation shown in FIGS. 2A–2B and FIGS. 3A–3B, a pair of machined slots are machined within the PCB 35 and intersect to form an "X"-shaped insertion point for each corresponding radiator pair. Because the radiators of the antennas 10 and 10' are preferably aligned within a linear array placed along a central axis extending along the major dimension of the antenna assembly, the corresponding machined slots 41 are likewise preferably positioned along a central axis extending along the major axis of the PCB 35.

Electrical connections from the top element 36 to the bottom element 38 are supported by plated-through holes 42, also called viaducts, on the PCB 35. In particular, one or more arrays of plated-through holes 42 can be positioned at each of the machined slots 41 to provide electrical connections to the radiating elements. The arrays of plated-through holes 42 boost current carrying capability and reduce RF impedance for the current path. The plated-through holes 42 permit connections to the dipole body of each preferred radiator element 12. Specifically, for a dipole radiator element, each dipole leg is connected to the RF ground provided by the ground plane of the conductive surface 39 along the bottom element 38, and the feed line, i.e., balun, is connected to a power divider circuit 37 of a distribution network. As shown in the expand view sections, one of the array of plated-through holes 42 preferably includes a larger set of holes than the remaining arrays to accommodate a common connection area for the preferred crossed-dipole radiator. In contrast to the plated-through holes 42, the machined slots 41 are free of any conductive plating surfaces.

This integrated implementation of the BFN 16 can be assembled in an efficient manner by applying the solder mask and paste at desired solder locations on the PCB 35, inserting the radiating elements 12 within the machined slots 41, and passing the entire assembly through a reflow oven to achieve the desired solder connections for the distribution network in a one-pass heating operation. Alternatively, the adhesive transfer barrier of the dielectric plate 17 can be attached to the ground plane 14 provided by the antenna tray and to the rear conductive surface 39 of the PCB 35. In turn, a solder mask and paste can be applied to the PCB 35, and the radiating elements 12 inserted within the machined slots 41. A localized heating source, such as a focused infrared, hot air source or specialized laser, can be used to apply heat to the areas on the PCB requiring solder connections.

Focusing now on the characteristics of the distribution network for the BFN 16, the antenna 10 can use a reactive (non-isolated) corporate power distribution network design, which is implemented in the preferred microstrip transmission media to perform elevation pattern beamforming. The amplitude and phase distribution at the individual radiators 12 is the result of this power distribution network design. Each distribution network of the BFN 16 comprises one or more individual junctions interconnected with a transmission line that connects the radiators to one or more external connection ports of the antenna.

A variety of amplitude and phase distributions can be used in an antenna array application for cellular communications to achieve specific pattern features of maximum peak gain, electrical downtilt, low sidelobes, and null fill beamshaping. This type of distribution can have both a non-uniform phase and amplitude distribution. The distribution of phase and amplitude is often chosen based upon qualities of emphasizing pattern coverage in some angular sectors (e.g., below the main beam) and de-emphasizing coverage in other angular sectors (e.g., above the main beam). As a consequence of beamshaping the phase distribution is often non-symmetrical and sometimes the amplitude distribution is non-uniform and non-symmetrical as well. Designs with maximum antenna gain correspond to a uniform phase and amplitude distribution and have pattern features with narrow beamwidths and symmetrical pattern features about the main beam. A linear phase distribution in conjunction with a uniform amplitude distribution can provide electrical downtilt with near-maximum peak gain.

Corporate-type power division is used in the preferred BFN 16 to avoid the frequency sensitive steering of the main antenna beam inherent in a series-type power divider architecture. Each distribution network is comprised of individual two-way (N=2, binary) power dividers where un-equal power division between the two output paths is the general case. Higher order (N>2) power division at a single junction is avoided in the preferred embodiment due to the corresponding higher transmission line impedance values of the individual output lines. Line impedance increases as the linewidth decreases for a microstrip media having constant substrate thickness and electrical properties. Thin (high impedance) lines are more sensitive to processing errors during fabrication. Thin lines generally result in more demanding (i.e., smaller) manufacturing tolerances in order to achieve the same degree of impedance match performance of the individual power divider. The exclusive use of two-way power dividers in this distribution network results in greater tolerance to fabrication errors of individual linewidths and results in lower cost processing.

Figure 5:
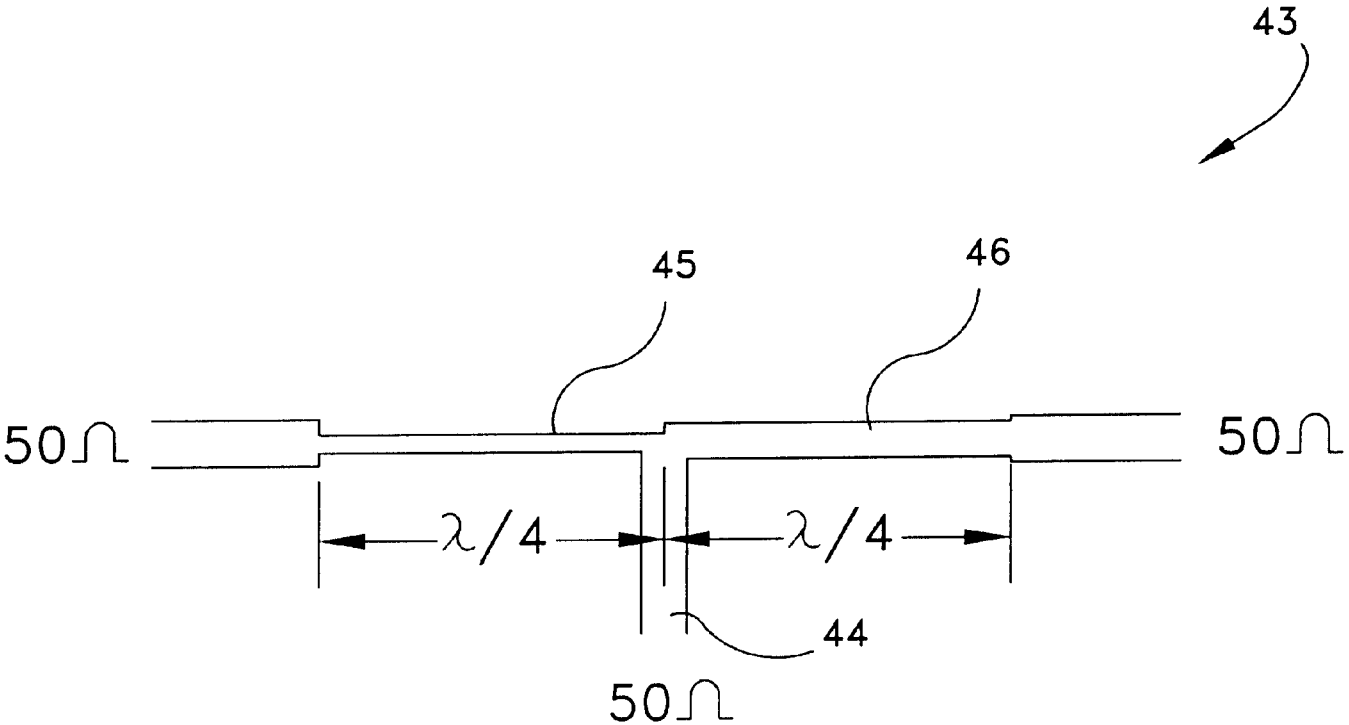
FIG. 5 is a diagram illustrating a portion of a distribution network for the beam forming network of an embodiment of the present invention.

FIG. 5 illustrates a two-way power divider for a distribution network of the BFN 16. Individual two-way power dividers in the distribution network determine the antenna array amplitude distribution. An individual power divider 43 shown in FIG. 5 is a three-port device, wherein one port may be designated the input port and the other two ports the output ports. An input transmission line 44 and all interconnecting transmission lines 45 and 46 in the preferred divider 43 are designed for 50 Ohm impedance. The two output transmission lines 44 and 46 of the junction have impedance values greater than 50 Ohms and the relative impedance of the two determines the relative power division among the two output ports. The 3-port power divider is commonly described as reactive and relies on the output ports being terminated into matched impedance to result in a matched condition on the input port. The analogous 4-port power divider has an additional port which, for matched conditions, has a phase condition of 180 degrees between the two output ports to transfer energy into the fourth port. The fourth port is ideally isolated from the input port. When the fourth port is terminated into a matched load, the resulting two-way power divider is categorized as an isolated power divider. The isolated port and the attendant load termination ideally does not have any power transferred into the load termination from power sourced from the input port. Only power reflected from the output ports and having an anti-phase (180 degree) condition will be terminated into the load termination. Commonly known examples of microstrip realizations of the isolated in-phase two way power divider are: 1) rat-race or ring hybrid, 2) Wilkenson divider, and 3) quadrature (90 degree) hybrid with Shiffman (90 degree) phase shifter on one output port. The isolated power divider provides a means to terminate reflected energy from non-ideal output port loads having anti-phase reflection coefficients. The co-phased reflected energy is passed back to the input port of both the reactive and isolated power dividers. The anti-phased reflected energy of non-ideal loads on the output ports of the reactive power divider is reflected at the power divider junction and redirected at the load terminations.

In general, a reactive power divider can result in greater variations in power transfer to non-ideal loads as a function of the frequency of operation due to multiple reflections. Greater voltage standing waves between reflection planes may result as well which can be a potential concern for voltage breakdown of dielectrics under high power conditions. However, the reactive power divider can offer a lower transmission loss solution to the power distribution network problem in contrast to the practical isolated divider when the output loads are reasonably well matched. Practical isolated dividers have some amount of forward power leakage into the load termination resulting in lower overall efficiency. Cascaded non-ideal isolated power dividers result in increased total loss for each tier in the divider chain due to leakage into the load terminations on the "isolated" ports. Hence, the reactive power divider network offers a lower realizable loss when other (conductor and dielectric) losses are equal and the output terminations are reasonably well matched. In addition, the reactive divider can be lower in cost and complexity without the need for isolation terminations.

The effective input impedance of a reactive power distribution network is real-valued and corresponds to 50 Ohms when each of the output load terminations are matched (e.g., 50 Ohms). The high impedance transmission line sections corresponding to the outputs of each power divider junction in a distribution network of the BFN 16 are transformed to 50 Ohms using a quarter-wave step transformer. A single quarter-wave section can be used in the transformer because the operating frequency bandwidth is sufficiently narrow. Greater numbers of sections in the transformer have been shown analytically to have little impact on the performance for the intended application frequency bandwidths. The conventional approach for a two-way reactive power divider in a T-configuration with the collinear arms as the output lines, is the length of each high impedance line is a quarter-wavelength at the center frequency of the operating frequency band in the transmission medium. For an equal-way amplitude division where the output lines have identical impedances, the physical lengths of the quarter-wave sections of line are identical. The lengths are often adjusted slightly from the ideal quarter-wave length to compensate for the reactive impedance of the step discontinuity at the junction between high impedance line and the 50 Ohm line. Hence, the transformer is frequency sensitive. The amount of length adjustment is different for the two lines when un-equal power division is implemented since the step discontinuities between the high impedance lines to the 50 Ohm lines are different.

FIG. 6 is an illustration showing a typically installation of the antenna 10 for operation as an antenna system for a PCS system. As emphasized in FIG. 5, the antenna 10 is particularly useful for sectorial cell configurations where the azimuth coverage is divided into K distinct cells. For this representative example, a tri-sectored (K=3) site having three antennas, antennas 10*a*, 10*b*, and 10*c*, centered at the base station, each with 120° (radians) coverage in azimuth and an effective coverage radius determined by the antenna gain, height, and beam downtilt. The antennas 10*a*, 10*b*, and 10*c* are mounted to a mounting pole 47 via top and bottom mounting brackets 48 attached to the rear surface of each antenna. Although FIG. 6 illustrates the use of a pole mounting for the antenna 10, it will be appreciated that mounting hardware can be used for flush mounting of the antenna assembly to the side of a building, as well as cylindrical arrangements for mounting the assembly to a pole or a tower.

The example of FIG. 6 illustrates that site conversion from space diversity to polarization diversity results in the replacement of the large antenna structure commonly associated with the requirement to physically separate the antennas. With the polarization diversity characteristics of the preferred antenna, three antenna assemblies can be mounted to a single mounting pole with mounting hardware to achieve tri-sectored coverage. This leads to the significant advantage of a smaller footprint for the antenna assembly, which has a smaller impact upon the visual environment than present space diversity systems.

Figure 7C:
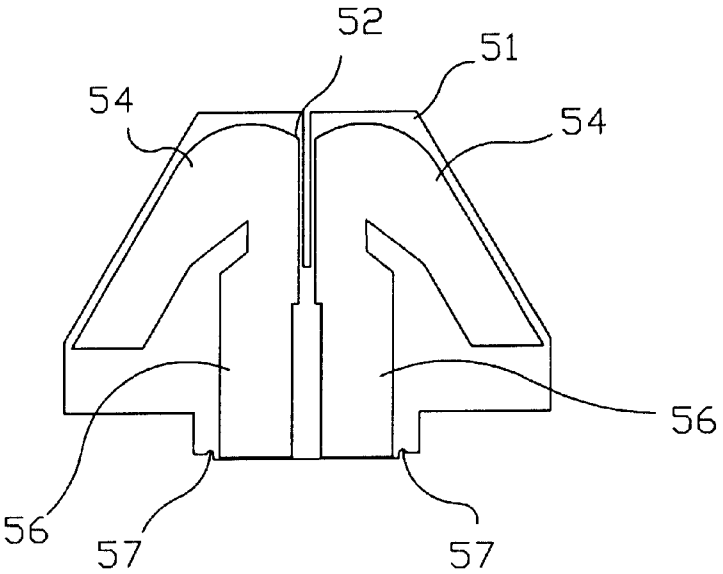
FIGS. 7A, 7B, and 7C, collectively described as FIG. 7, are illustrations showing the alternative faces and a side edge of a dielectric substrate for a single radiating element for an exemplary embodiment of the present invention.
Figure 7B:
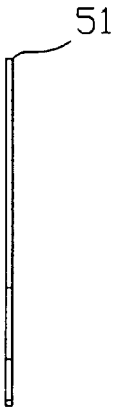
Figure 7A:
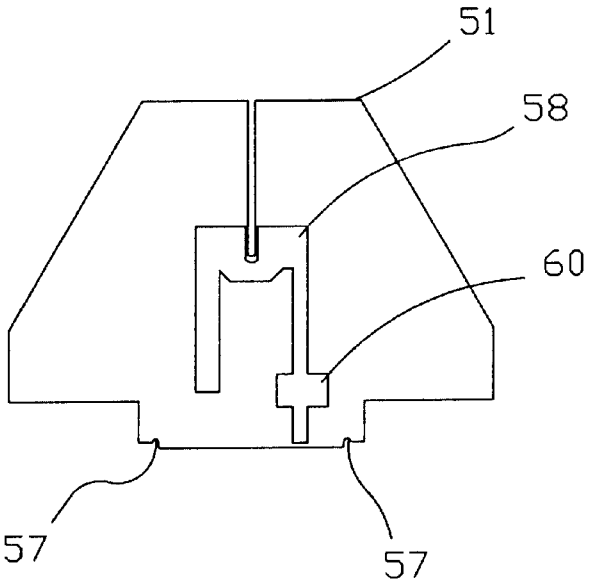
Figure 8B:
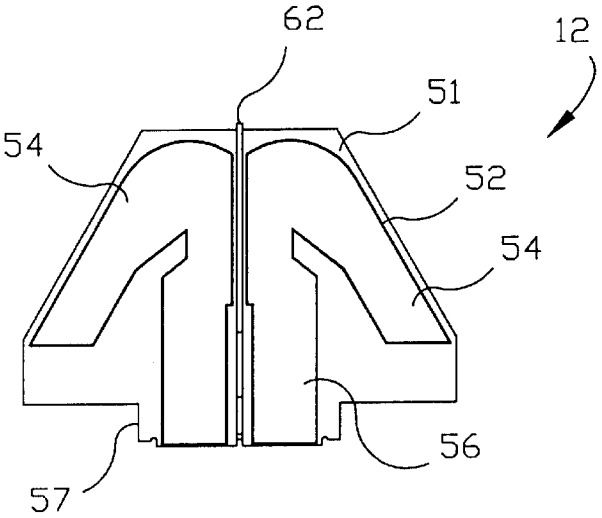
FIGS. 8A, 8B, 8C, and 8D, collectively described as FIG. 8, are illustrations showing side and perspective views of an assembled pair of radiating elements for an exemplary embodiment of the present invention.
Figure 8D:
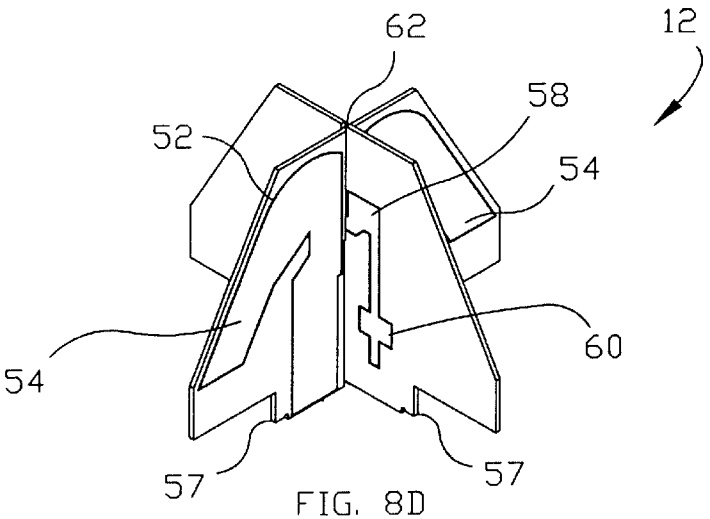
Figure 8A:
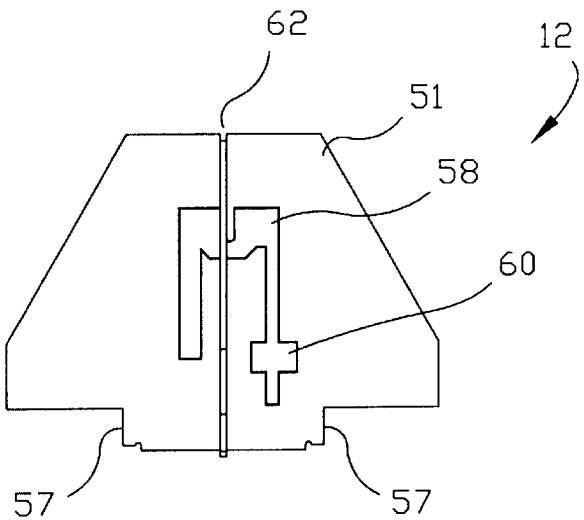
Figure 8C:
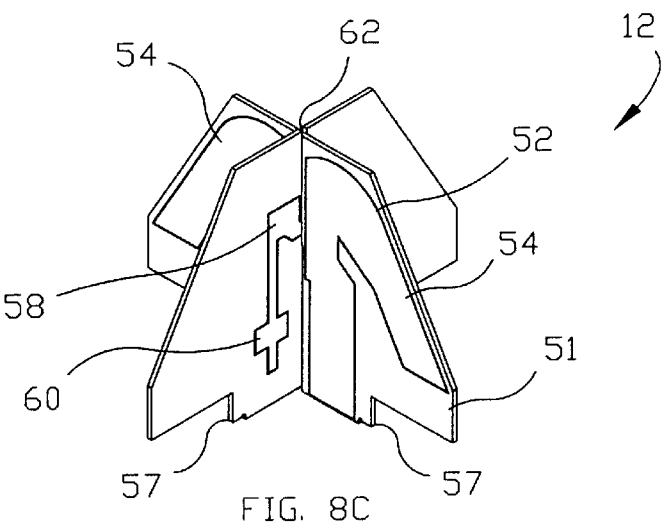

FIG. 7, comprising FIGS. 7A, 7B, and 7C are illustrations respectively showing a face, side, and opposite face views of a dielectric substrate that supports an exemplary implementation of a radiating element. Referring first to FIG. 7C, a dipole antenna 52 for each radiating element 12 is formed on one side of a dielectric substrate 51, which is metallized to form the necessary conduction strips for a pair of dipole arms 54 and a body 56. The dipole antenna 52 is photo-etched (also known as photolithography) on the dielectric substrate 51. The width of the strips forming the dipoles arms 54 is typically chosen to provide sufficient operating impedance bandwidth of the radiating element. The same face occupied by the dipole arms 54 contains the dipole body 56, which comprises a parallel pair of conducting strips or legs useful for electrically connecting the dipole arms 54 to the rear conductive surface 39 (FIG. 4C) of the BFN 16 via plated-through holes 42 (FIGS. 4A and 4C). The length of the conductive strips from the crossing location of a feed line 58 (FIG. 7A) on the opposite face of the dielectric plate is approximately one-quarter wavelength at the center frequency of the selected operating band. Each feed line is configured to include a balun element, such as a balun 60. The width of the conducting strips or legs of the dipole body 56 increases approaching the dipole element base in order to provide an improved radio-electric ground plane for the microstrip feed line 58 (FIG. 7A) on the opposite face of the dielectric plate.

On the face opposite the dipole antenna 52, as shown in FIG. 7A, is the feed line 58, which has a microstrip form that couples energy into the dipole arms 54 (FIG. 7C). As before, the microstrip feed line 58 is photo-etched on the surface of the dielectric substrate 51. The feed line 58, which includes the balun 60, is terminated in an open circuit, wherein the open end of the feed line is approximately one-quarter wavelength long as measured from the crossing location at the center frequency of the operating band. Unlike the dipole legs of the dipole body 56, the feed line 58 is connect to a power divider 37 of the PCB 34 rather than to the RF ground potential of the rear conductive surface 39. The preferred embodiment of the feed line 58, which runs from the base of the dipole antenna 52 (FIG. 7C) to the region near the crossover, presents a 50 Ohm impedance.

The bottom edge of the dielectric substrate 51 can be inserted into one of the machined slots 41 to mount the dipole element to the BFN 16. To achieve this result, opposite edges of the bottom portion of the dielectric substrate 51 include notches 57 to support the insertion of the radiating element within a machined slot 41. Thus, the notched bottom portion of the radiating element is sized to properly sit within a machined slot after insertion.

The dielectric substrate 51 is a relatively thin sheet of dielectric material and can be one of many low-loss dielectric materials used for the purpose of radio circuitry. The preferred embodiment is a material known as MC-5, which has low loss tangent characteristics, a relative dielectric constant of 3.26, is relatively non-hygroscopic, and relatively low cost. MC-5 is manufactured by Glasteel Industrial Laminates, a division of the Alpha Corporation located in Collierville, Tenn. Lower cost alternatives, such as FR-4 (an epoxy glass mixture) are known to be hygroscopic and generally must be treated with a sealant to sufficiently prevent water absorption when exposed to an outdoor environment. Water absorption is known to degrade the loss performance of the material. Higher cost Teflon based substrate materials are also likely candidates, but do not appear to offer any compelling advantages.

Although each radiating element 12 is preferably a printed implementation of a dipole antenna, it will be understood that other implementations for the dipole antenna can be used to construct the antenna 10. Other conventional implementations of dipole antennas can also be used to construct the antenna 10. Moreover, it will be understood that the radiating element 12 can be implemented by antennas other than a dipole antenna.

FIGS. 8A, 8B, 8C, and 8D, collectively described as FIG. 8, are illustrations of various views of the crossed dipole pair. Each dielectric substrate 51 includes a slot 62 running along the center portion of the plate and within a nonmetallized portion of the dielectric substrate that separates the parallel strips of the dipole body 56. A set of interleaving slots 62 in a pair of the dielectric substrates 51 facilitate crossly orienting the pair of dipole antennas 52 orthogonal with respect to each other. The microstrip feed lines 58 alternate in an over-under arrangement within the cross-over region to prevent a conflicting intersection of the two feed lines. The crossly oriented dipole antennas 52 are largely identical in the features except for the details near the crossover region of the feed lines 58. The differences in strip width of the dipole body 56 provide effectively the same impedance match characteristics of the reference location at the base of the radiating element.

Figure 9:
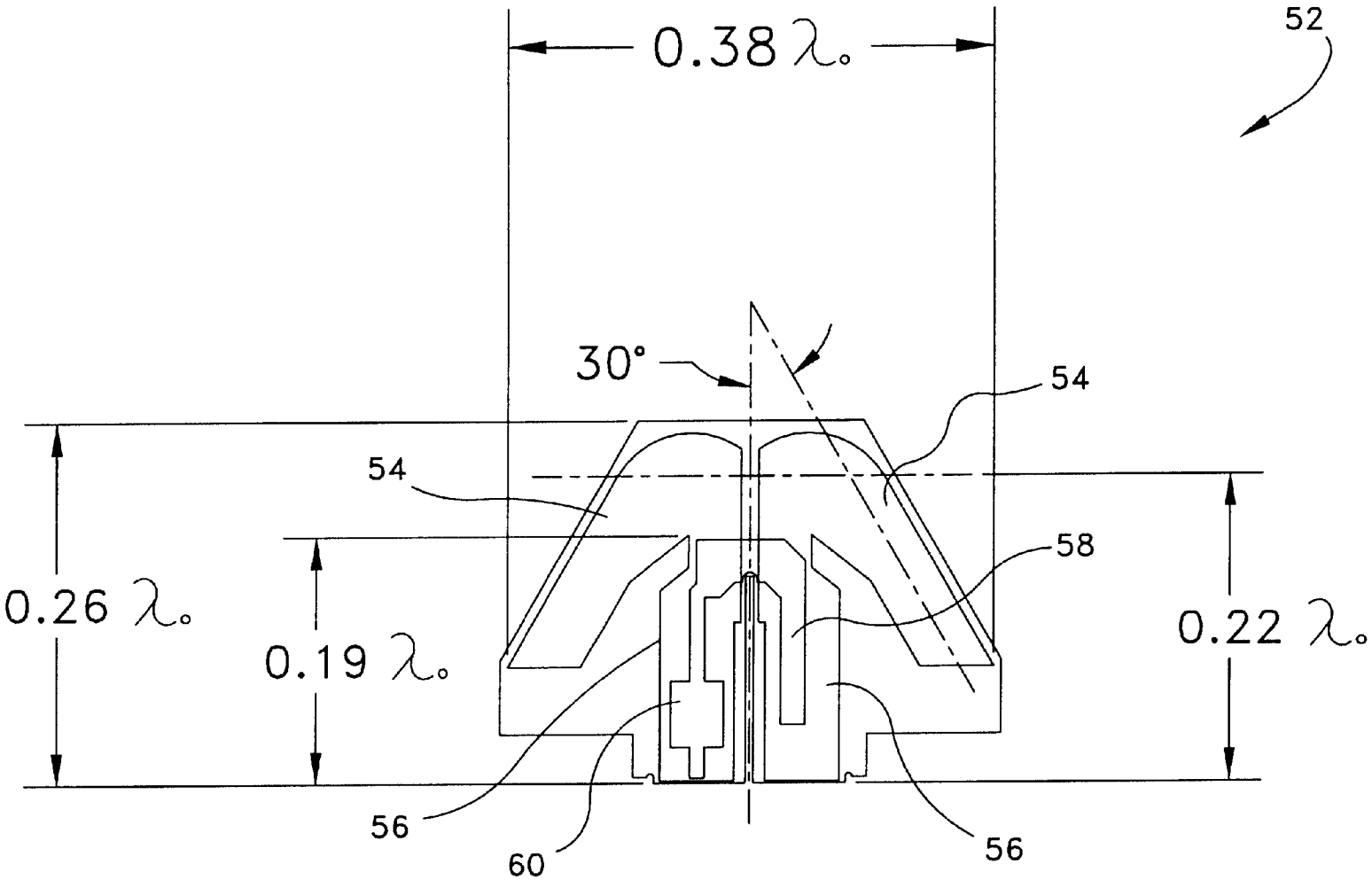
FIG. 9 is an illustration showing the dimensions of an assembled pair of radiating elements for an exemplary embodiment of the present invention.

Referring now to FIG. 9, which shows the preferred dimensions of the dipole antenna configuration for the PCS frequency spectrum, each radiating element 12 includes dipole arms 54 having a swept down design to form an inverted "V"-shape. When mounted, the height of the dipole arms above the ground plane 14 is approximately 0.26 wavelength. The angle of the dipole arms 54 is approximately 30 degrees. The pair of dipoles arms 54 has a overall span extending approximately one-half wavelength and a width of approximately 0.38 wavelength. The height of the vertex of the lower edge of the dipole arms 54 and the body 56 is 0.19 wavelength. The height of the centroid of the dipole arms 54 near the vertex of the dipole antenna 52 is approximately 0.22 wavelength. It will be appreciated that the width of the dipole arms 54 is predominately determined from frequency bandwidth considerations. For example, a narrow dipole arm generally results in a smaller operating impedance bandwidth. In addition, it will be understood that the details of the geometry for the vertex of the lower edge of the dipole arms 54 and the body 56 do not appreciably influence antenna performance other than impedance characteristics.

The reactive power distribution network of the BFN 16, when terminated in non-ideal loads, can result in complicated interactions between ports since the number of reflection planes can be many for the multi-port power distribution network having many connections; both external and internal. Typically, array antennas of the type disclosed herein are terminated with identical radiators or radiating elements. The practical radiator is a non-ideal load termination having an input impedance of the radiator that is not identically 50 Ohms, although the initial design goal is to realize a radiator having an impedance which has this property over the frequency band of operation. When the impedances of non-ideal radiators represent the load impedance of the power distribution network, the net input impedance of the power distribution network can have an effective impedance match which does not satisfy the desired performance even though the radiator impedance matches are sufficient to meet the performance on an individual basis.

One of the features of an alternative embodiment is to terminate the power distribution network with radiators that do not have like or near-identical reflection coefficients characterized relative to 50 Ohms in order to achieve the desired network input impedance. By doing so, the complex interactions of the small, yet significant, individual reflection coefficients can lead to a degree of cancellation which results in an improvement of the network input impedance in contrast to a network terminated with near-identical radiator impedance's. Hence, both phase and amplitude of the reflection coefficient of the individual radiator comes into play in canceling the reflected energy at the network input port.

Figure 10B:
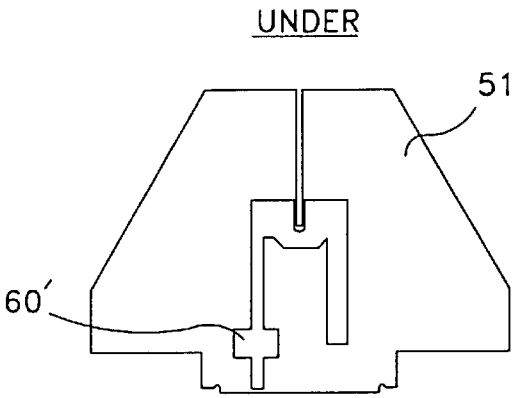
FIGS. 10A and 10B, collectively described as FIG. 10, are illustrations showing the reciprocal images of a feed element for a radiating element of an embodiment of the present invention.
Figure 11B:
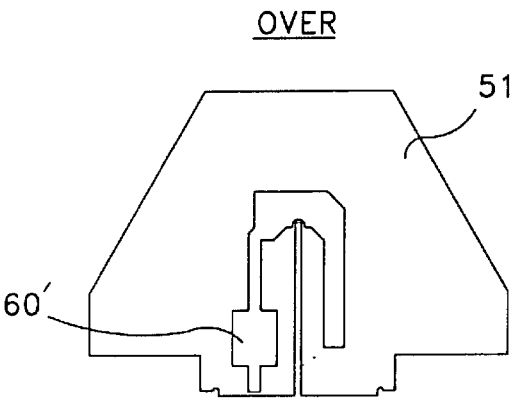
FIGS. 11A and 11B, collectively described as FIG. 11, are illustrations showing the reciprocal images of an alternative feed element for a radiating element of an embodiment of the present invention.
Figure 10A:
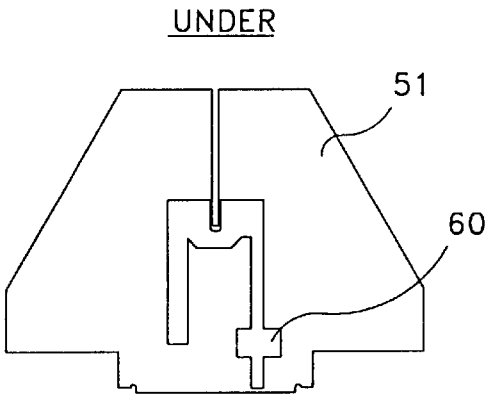
Figure 11A:
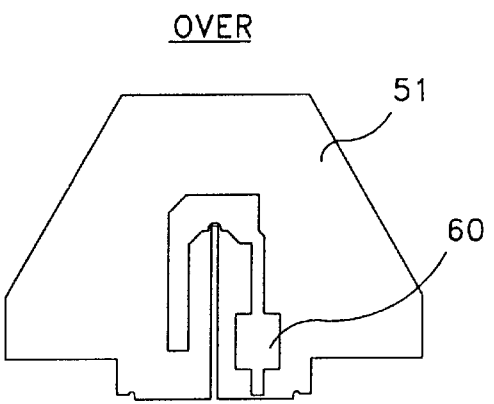

Several techniques have been utilized to achieve the desired result of an improvement in network input impedance. As shown in FIGS. 10A and 10B (and FIGS. 11A–11B), one technique for the dual-polarized application is to use a printed image of a balun element of the transmission feed line on the dipole radiator. The printed image of a balun element, shown as balun 60' in FIG. 10B (and FIG. 11B), allows placement of dipoles in the antenna array which have baluns of the "over" and "under" type terminating the power distribution network. The practical realization of an "over" and "under" balun has not realized identical impedance characteristics due to the natural absence of symmetry in the structure. Under-type baluns are shown in FIGS. 10A–10B, whereas over-type baluns are shown in FIGS. 11A–11B. Hence, the selective location of "over" and "under" pairs of dipoles and the image pairs within the array affords additional degrees of freedom in the final design optimization. The best locations for differing dipole pairs within the array is dependent upon the number of array elements, the network phase and amplitude distribution, and external sources of reflections such as the non-ideal radome. The best locations have been determined using empirical techniques in the design optimization.

A second technique, which is illustrated by the different balun configurations in FIGS. 10A and 11A (and FIGS. 10B and 11B), is to simply alter the impedance function of the individual dipole within the array by adjustment of the balun artwork features. In this manner, all the dipoles corresponding to the power distribution network can be "unders" or "overs". The individual reflection coefficients can be altered in this manner and the best results again have similar dependencies on the aforementioned conditions.

Figure 12B:
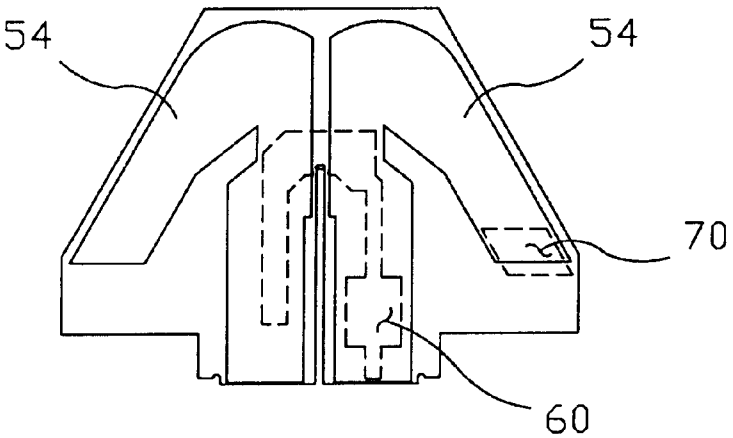
FIGS. 12A and 12B, collectively described as FIG. 12, are illustrations showing the pair of faces of an alternative design for a single radiating element for an exemplary embodiment of the present invention.
Figure 12A:
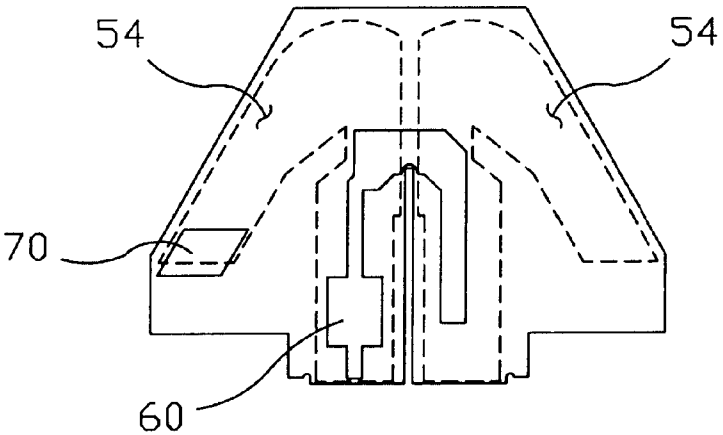
Figure 13:
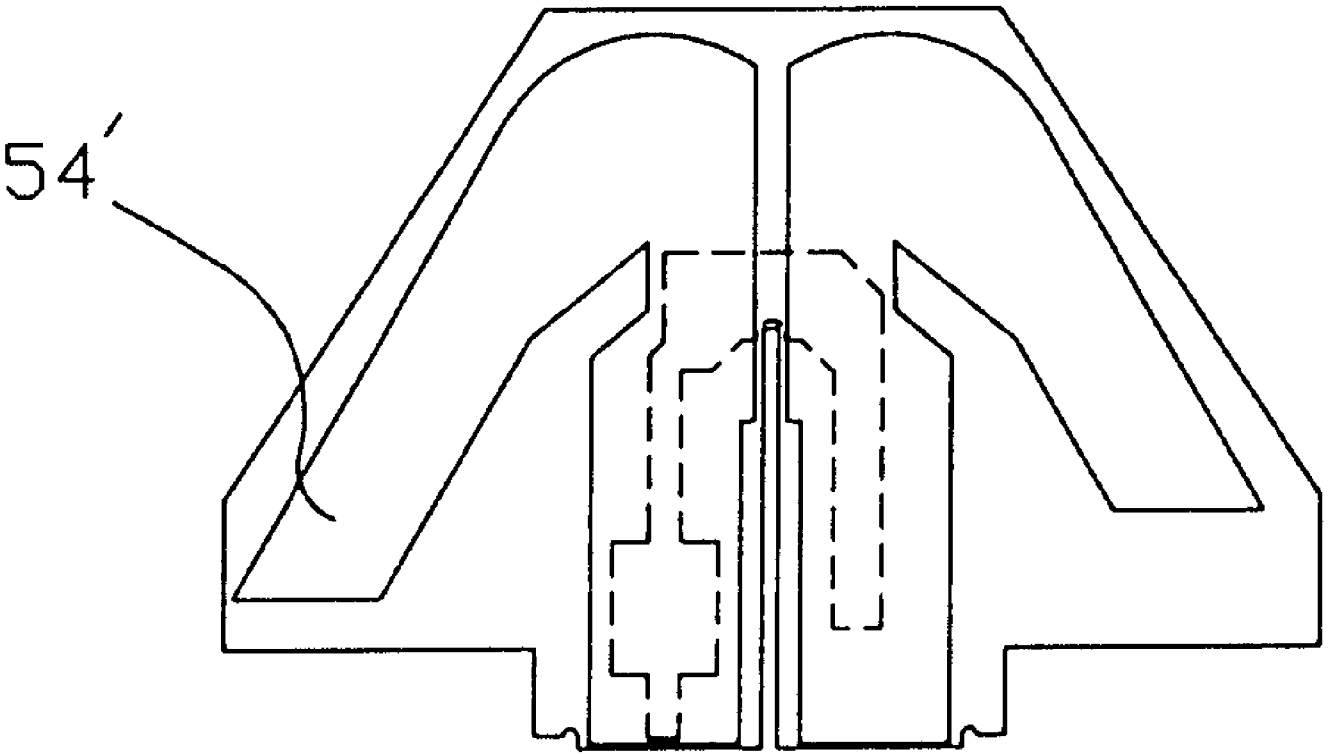
FIG. 13 is an illustration showing the pair of faces of an alternative design for a single radiating element for an exemplary embodiment of the present invention.

A third technique, illustrated in FIGS. 12A–12B, is to change the individual dipole input impedance by use of a small capacitor plate 70 on the opposite side of the dipole arm 54, near the end of the dipole arm. This application of capacitive loading the dipole results in a change in the input impedance as measured at the reference plane at the input to the dipole balun 60. A fourth technique, shown in FIG. 13, is achieved by altering the length of a dipole arm 54' either symmetrically or asymmetrically can produce a similar effect.

An additional technique (not shown) used separately or in conjunction with the techniques applied to the radiator is to alter the length of the high impedance lines within the power distribution network to cause effective cancellation of individual reflections in whole or partially across the frequency band of operation. This added degree of freedom in the design is again a departure from the conventional methods to achieve a net input impedance which satisfies the performance objectives of the whole network without significantly altering the desired amplitude and phase distribution used to achieve the pattern features. Typically, the input impedance objective for the antenna design is a maximum VSWR of less than 1.35:1 corresponding to a return loss value of less than −16.5 dB. Additional margin is applied to guarantee with a reasonable degree of confidence that the specification is achieved over a normal outdoor environmental temperature range. All five network tuning optimization techniques can be implemented with low cost printed circuit technology.

Figure 14:
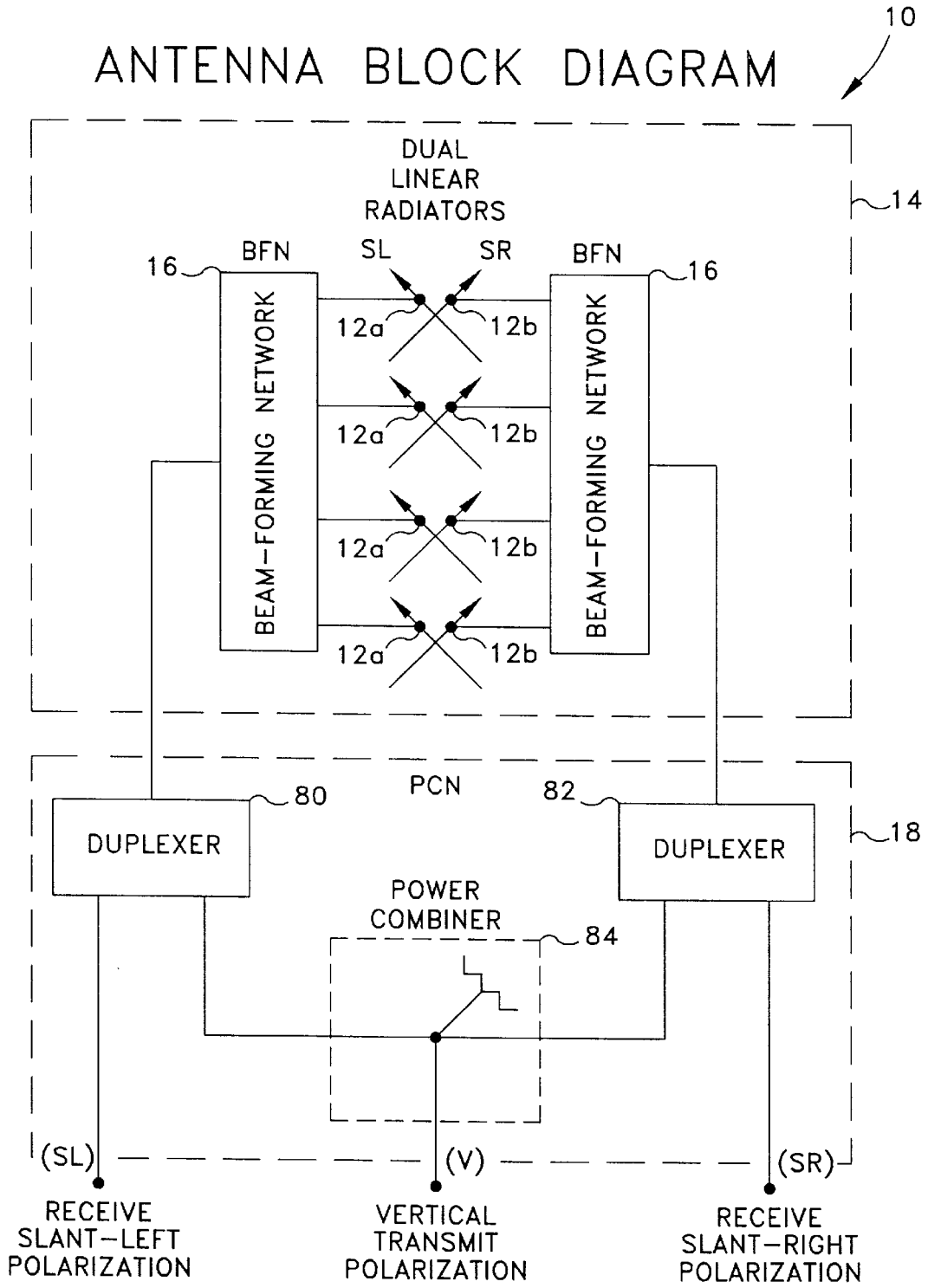
FIG. 14 is a block diagram illustrating a polarization control network for the preferred embodiment of the present invention.

FIG. 14 is a block diagram illustrating the preferred components for a PCN of an embodiment of the antenna 10. Referring now to FIG. 14, the preferred PCN comprises a pair of duplexers 80 and 82 and a power combiner 84. Each of the duplexers 80 and 82 can be connected between the BFN 16 and the power combiner 84. In particular, the duplexer 80 is connected to the distribution network for the radiating element 12 having a slant left polarization state, whereas the duplexer 82 is connected to the distribution network for the radiating element 12 having a slant right polarization state. In response to a receive signal having a slant left polarization state from the BFN 16, the duplexer 80 outputs the receive signal via an output port. The duplexer 82 outputs via an output port a receive signal having a slant right polarization in response to the receive signal from the BFN 16. The power combiner 84 accepts a transmit signal from a transmit source and distributes this transmit signal to the duplexer 80 and to the duplexer 82. The duplexer 80 and the duplexer 82 accept the transmit signal from the power combiner 84 and, in turn, output the transmit signal to the BFN 16. The antenna 10 effectively radiates a vertical polarization state resulting from equal in-phase excitation of the two basic polarizations.

Figure 15:
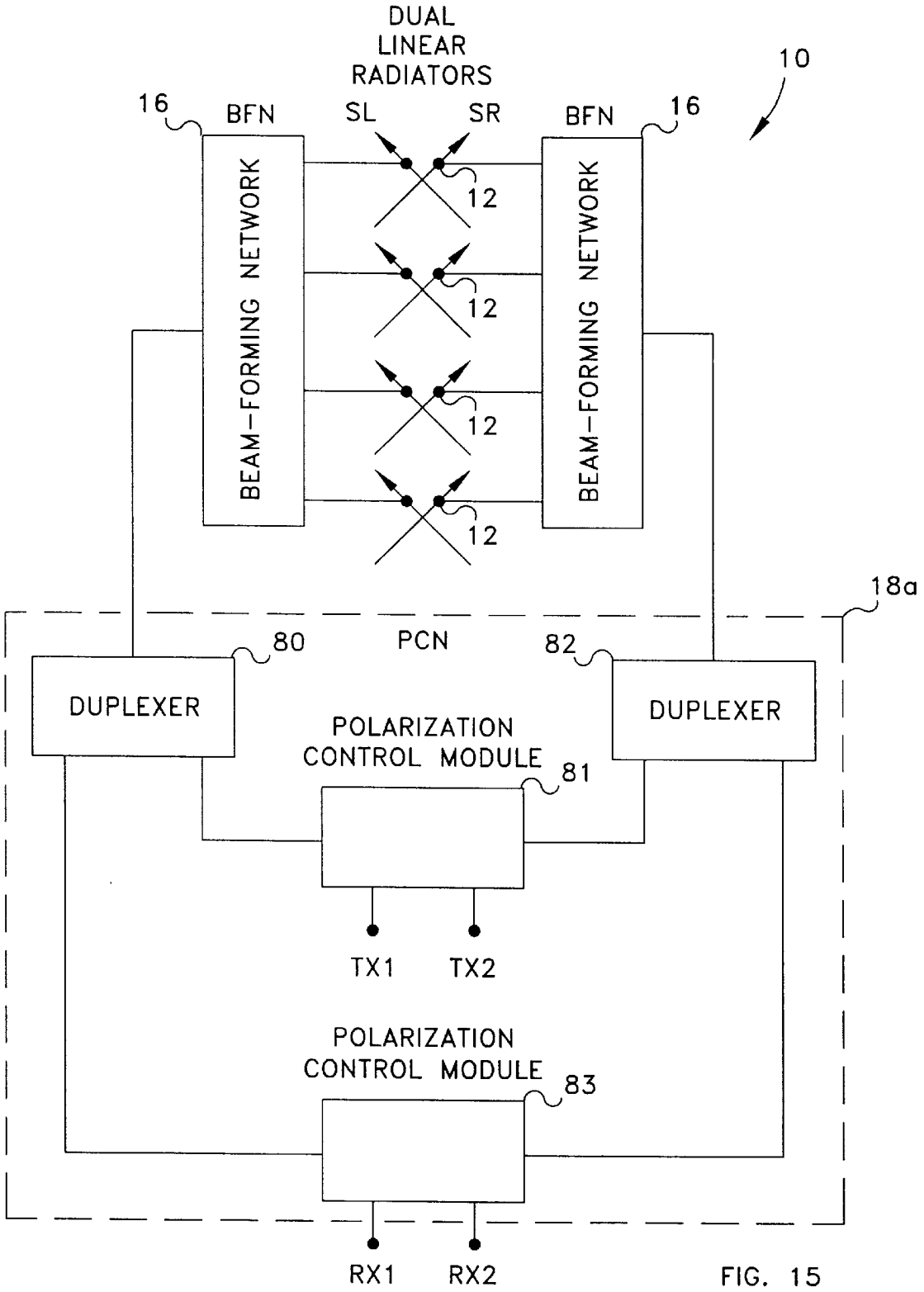
FIG. 15 is a block diagram illustrating a polarization control network for an alternative embodiment of the present invention.

It will be appreciated that the antenna 10 is not limited to an application for receive slant right and slant left polarization signals and transmit vertical polarization signals. As shown in FIG. 15, a PCN 18*a* includes a first polarization control module 81 for accepting a pair of transmit signals from a transmit source and a second polarization control module 83 for outputting a pair of receive signals. The first polarization control module 81 and the second polarization control module 83 are connected to the duplexers 80 and 82. In response to the transmit signals TX1 and TX2, the polarization control module 81 outputs transmit signals to the duplexers 80 and 82. In addition, the duplexers 80 and 82 output receive signals to the second polarization control module 83 which, in turn, outputs receive signals RX1 and RX2. In this manner, the four ports of the pair of duplexers 80 and 82 can be combined to provide desired pairs of transmit and receive signals. The polarization control modules 81 and 83 can be implemented by a 0°/90°-type hybrid coupler, commonly described as a quadrature hybrid coupler, or a 0°/180°-type hybrid coupler, which is generally known as a "rat race" hybrid coupler.

Figure 16:
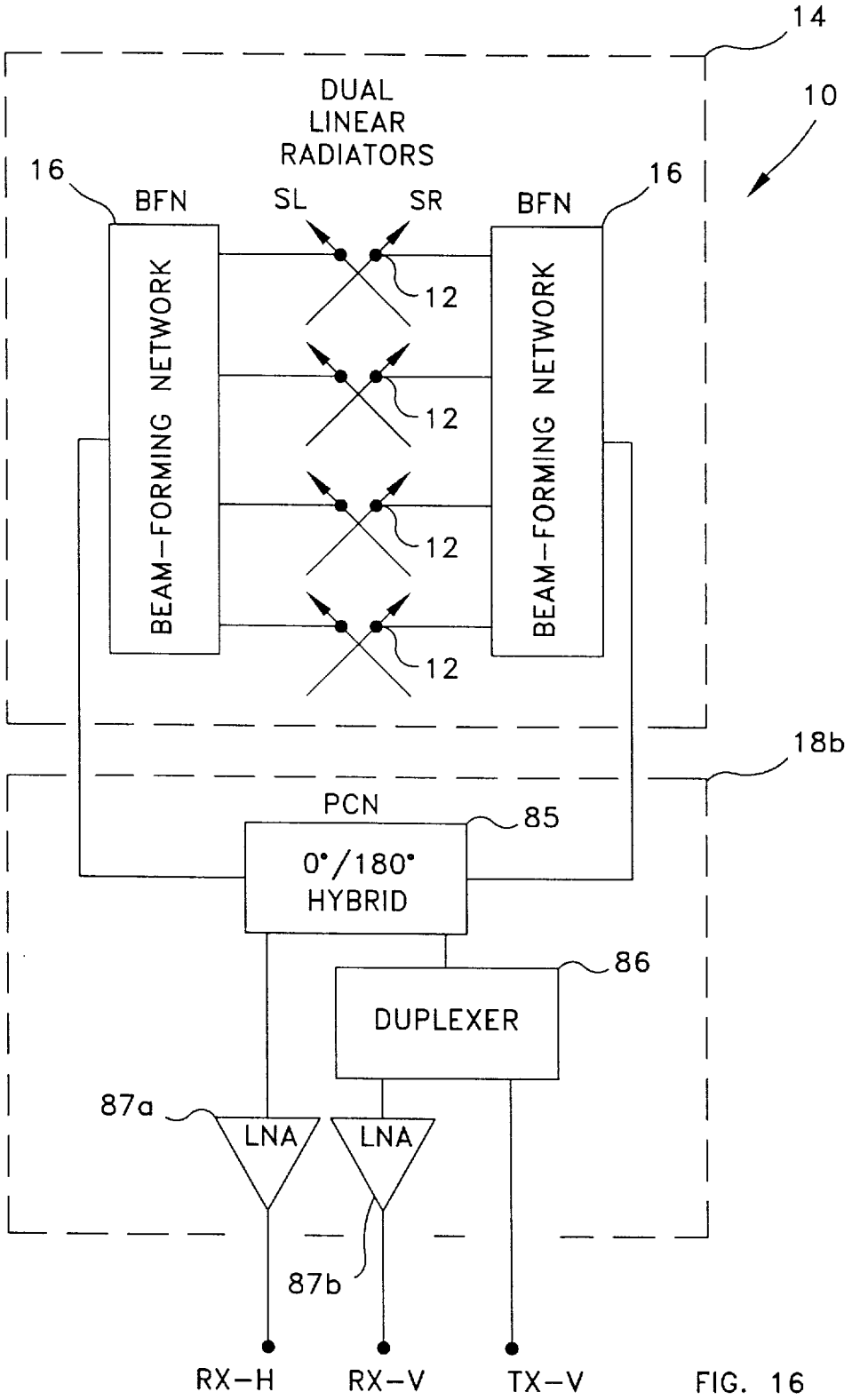
FIG. 16 is a block diagram illustrating a polarization control network for an alternative embodiment of the present invention.

FIG. 16 is a block diagram illustrating another alternative embodiment of a polarization control network. Referring now to FIG. 16, a PCN 18*b* comprises a 0°/180°-type hybrid coupler 85, a duplexer 86, and low noise amplifiers (LNA) 87*a* and 87*b*. The hybrid coupler 85, which can be connected to the BFN 16, the duplexer 86, and the LNA 87*a*, transfers signals to and from the distribution networks of the BFN 16. In addition, the hybrid coupler 85 outputs a receive signal having a horizontal polarization state to the LNA 87*a* and a receive signal having a vertical polarization state to the duplexer 86. The duplexer 86 comprises a common port connected to the hybrid coupler 85, a receive port connected to the LNA 87*b*, and a transmit port. The common port of the duplexer 86 accepts receive signals having a vertical polarization state from the hybrid coupler 85 and distributes transmit signals having a vertical polarization state to the hybrid coupler 85. The receive port of the duplexer 86 outputs a receive signal having a vertical polarization state to the LNA 87*b*, whereas the transmit port accepts a transmit signal having a vertical polarization state. Consequently, it will be understood that the duplexer 86 is capable of separating receive signals from transmit signals based on the frequency spectrum characteristics of the signals. The LNAs 87*a* and 87*b*, which are respectively connected to the hybrid coupler 85 and the duplexer 86, amplify the received signals to improve signal-to-noise performance. The LNA 87*a* amplifies a receive signal having a horizontal polarization state, whereas the LNA 87*b* amplifies a receive signal having a vertical polarization state. It will be appreciated that the LNAs 87*a* and 87*b* can be eliminated from the construction of the PCN 18*b* in the event that the PCN is positioned at the receiver of the wireless communication system rather than at the antenna site.

A PCN implemented with a hybrid coupler can perform mathematical functions to convert the dual linear slant polarizations (SL/SR) of the preferred embodiment to a vertical/horizontal (V/H) pair or to a right-hand circular/left-hand circular (RCP/LCP) pair, respectively. These polarization conversions can be accomplished without altering the antenna azimuth pattern beamwidth of the co-polarized radiating elements when the radiation pattern is rotationally symmetric. A necessary condition for the use of these hybrid couplers to accomplish the polarization conversion operation with invariant beamwidths is that the group electrical paths (phase delay) lengths of the paths corresponding to exciting the natural characteristic polarizations of the antenna array are reasonably well matched. This same matching condition is necessary for the amplitude characteristic.

Figure 17:
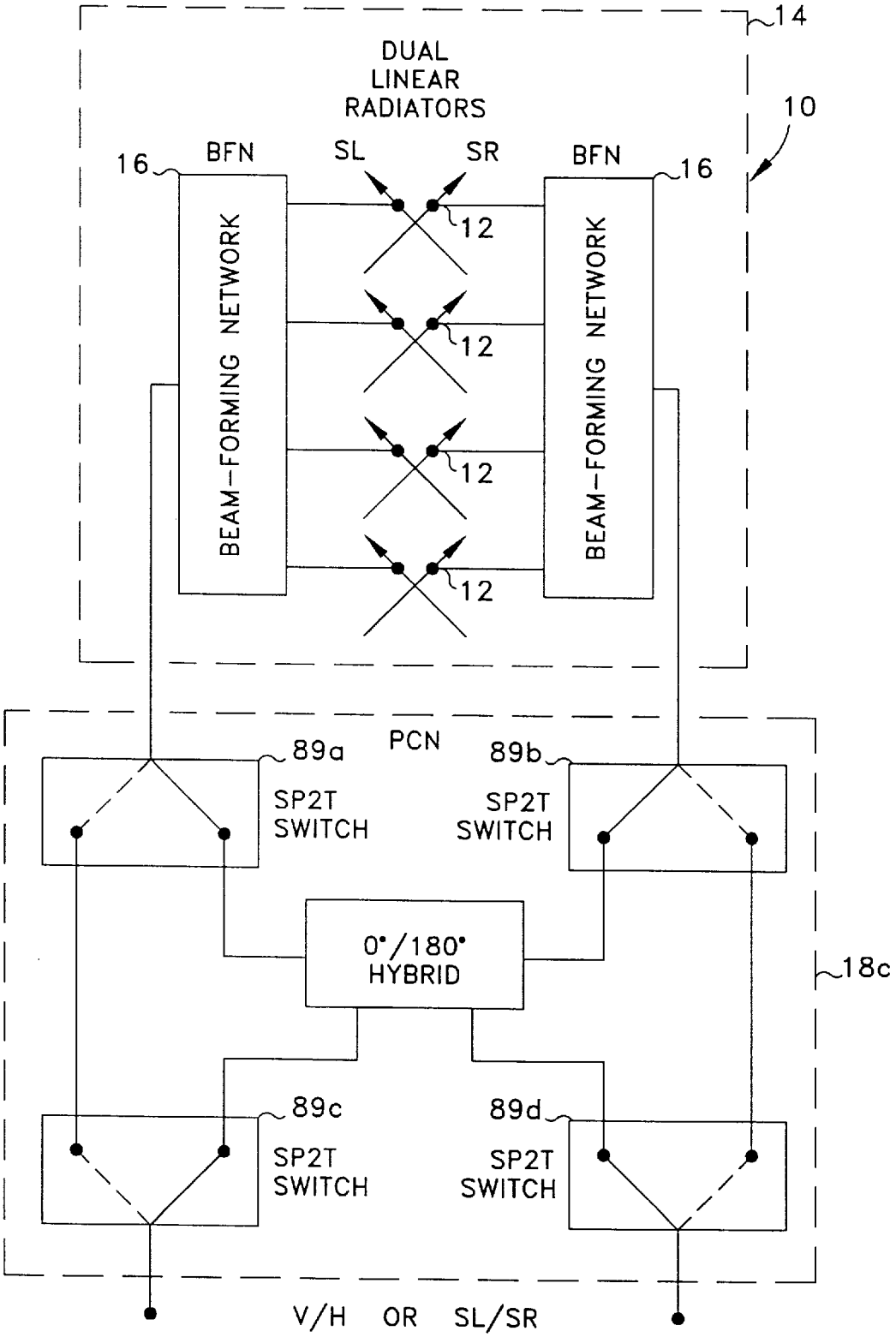
FIG. 17 is a block diagram illustrating a polarization control network for an alternative embodiment of the present invention.

FIG. 17 is a block diagram illustrating yet another embodiment for the polarization control network. Turning now to FIG. 17, a PCN 18*c* comprises a 0°/180°-type hybrid coupler 88 and switches 89*a–d* to provide four polarization states, specifically vertical, horizontal, slant left, and slant right polarization states, for polarization diversity selection. The common ports of the switches 89*a* and 89*b* can be connected to the distribution networks of the BFN 16. In addition, the normally closed ports of the switches 89*a* and

89*b* are connected to the hybrid coupler 88, whereas the normally open ports are directly connected to the switches 89*c* and 89*d*. In similar fashion, the normally closed ports of the switches 89*c* and 89*d* are connected to the hybrid coupler 88, whereas the normally open ports are directly connected to the switches 89*a* and 89*b*. The common ports of the switches 89*c* and 89*d* serve as output ports for supplying receive signals having selected polarization states.

For the normally closed state of the switches 89*a–d*, the hybrid coupler 88 is inserted for operation within the PCN 18*c*, whereas the normally open state of the switches 89*a–d* serves to bypass the hybrid coupler 88. Consequently, for the normally open state, the common ports of the switches 89*c* and 89*d* supply receive signals having slant left and slant right polarization states. In contrast, for the normally closed state, the common ports of the switches 89*c* and 89*d* output receive signals having vertical and horizontal polarization states. This allows the user to select the desired polarization state for the receive signals at the base station receiver.

The switches 89*a* and 89*b* can be implemented by single pole, double throw switches, whereas the switches 89*c* and 89*d* can be implemented by single pole, double throw switches or a single pole, four throw switch.

Figure 18:
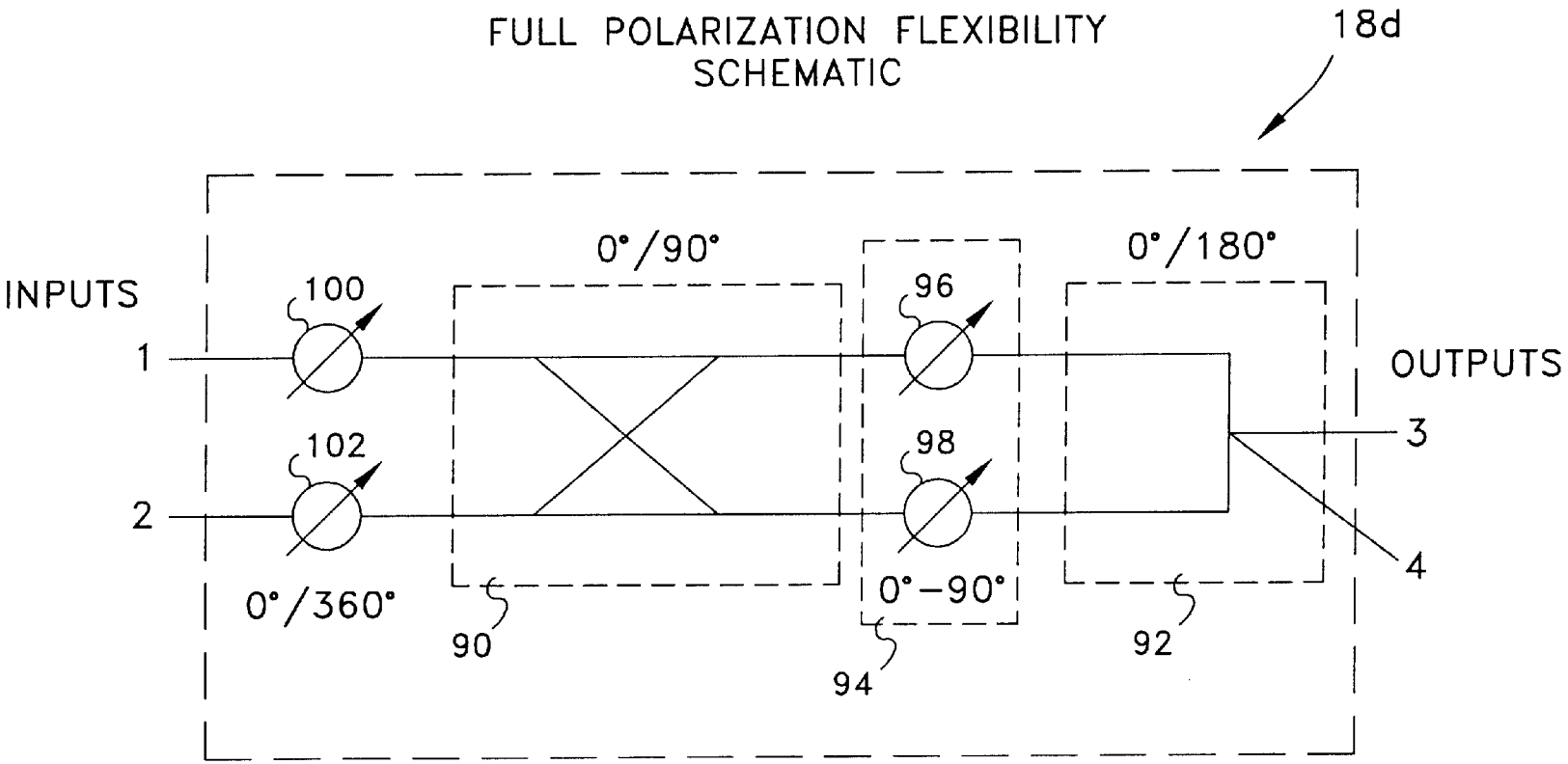
FIG. 18 is a block diagram illustrating a polarization control network for an alternative embodiment of the present invention.

FIG. 18 is a block diagram illustrating another alternative embodiment for a polarization control network. As shown in FIG. 18, a PCN 18*d* involving more than a single component will allow the desired polarization transformation to occur with pattern beamwidth invariance in the presence or condition of amplitude and/or phase imbalance between the two natural polarization components. The PCN 18*d* may be categorized as a variable power distribution network for which the relative phase delay of phase shifters 96 and 98 determines the power distribution between ports of the PCN. The PCN 18*d* comprises a pair of hybrid couplers 90 and 92 interconnected by a transmission module 94 operative to impart an unequal phase delay. The hybrid coupler 90, which is preferably implemented as a 0/90 degree-type hybrid coupler, is functionally connected between the input ports 1 and 2 and the transmission module 94. The hybrid coupler 92, which is preferably implemented as a 0/180 degree-type hybrid coupler, is functionally connected between the output ports 3 and 4 and the transmission module 94. A pair of phase shifters 96 and 98, inserted within the transmission lines of the transmission module 94, provide a phase delay between the hybrid couplers 90 and 92. The phase shifters 96 and 98 can be implemented as unequal lengths of transmission line, i.e., a passive phase shifter or can be variable phase shifters permitting control over the phase delay between the couplers 90 and 92. In addition, a pair of phase shifters 100 and 102 can be inserted between the input ports and the hybrid coupler 90 to permit complete control over the phase of signals entering the PCN 18*d* This configuration for the PCN 18*d* mallows complete polarization synthesis such that any two orthogonal pairs may be produced as the characteristic antenna polarization. If one or more of the passive phase delay units are replaced by a controllable phase shifter, then polarization agility can be implemented with pattern beamwidth invariance.

Referring again to FIGS. 2–4, for PCS frequencies, the radio-electric transverse extent of the ground plane is nominally 10 inches ($5\lambda_o/3$) to achieve the desired polarization performance. When this parameter is "scaled" to lower operating frequencies, for example, to the typical cellular mobile radiotelephone band with a center frequency of 851 MHz, the physical size of the radio-electric ground plane increases. At this typical cellular frequency, the equivalent transverse dimension of the ground plane 14 is approximately 22.5 inches. The dimension in the array plane scales in the same manner to achieve the same antenna directivity value and to conserve the number of array elements. It will be appreciated that it is desirable to minimize the physical transverse dimension to reduce the wind loading and cost, and to improve the general appearance by reducing the antenna size.

Figure 19:
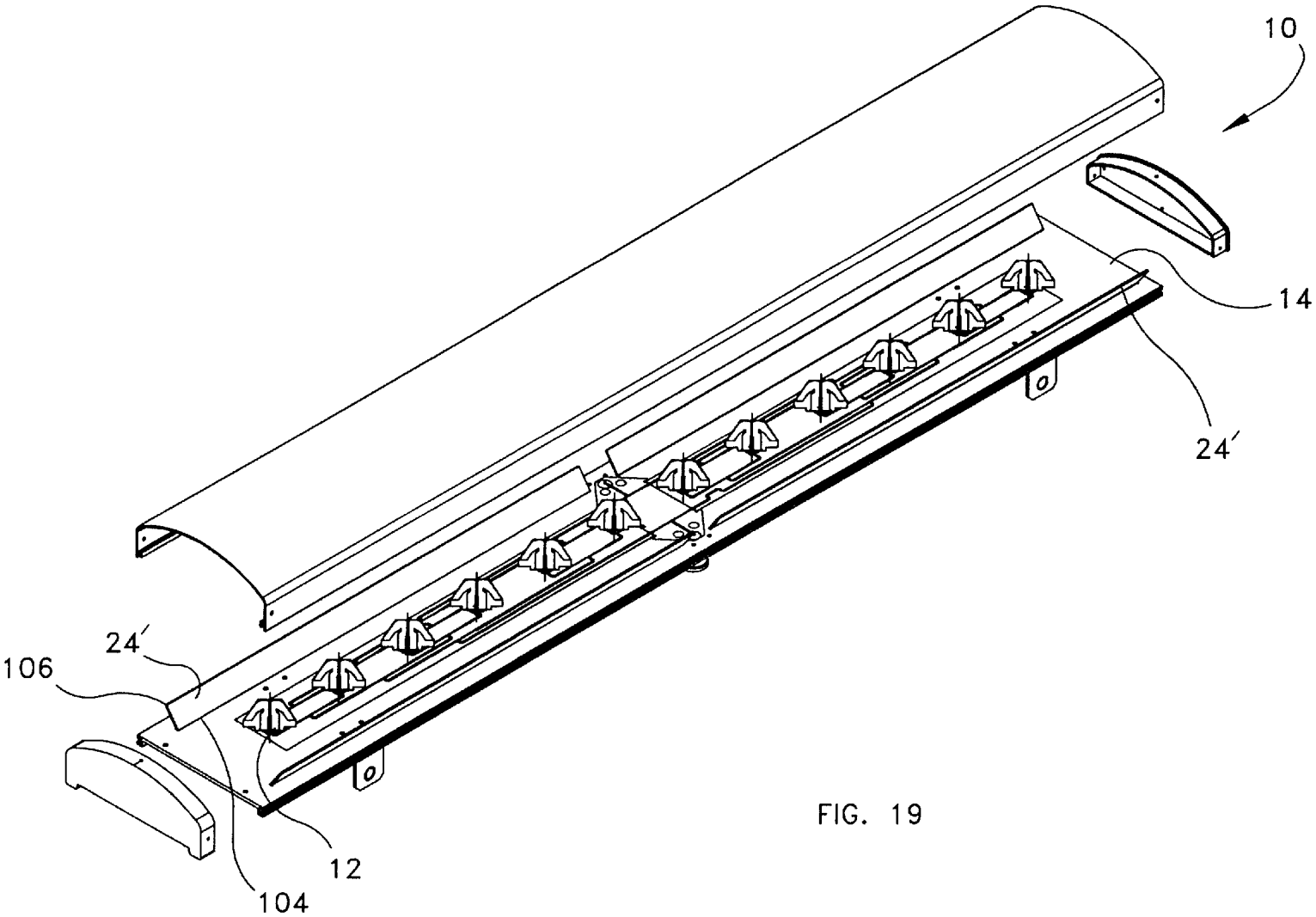
FIG. 19 is a block diagram illustrating a pair of side walls for an alternative embodiment of the present invention.
Figure 20:
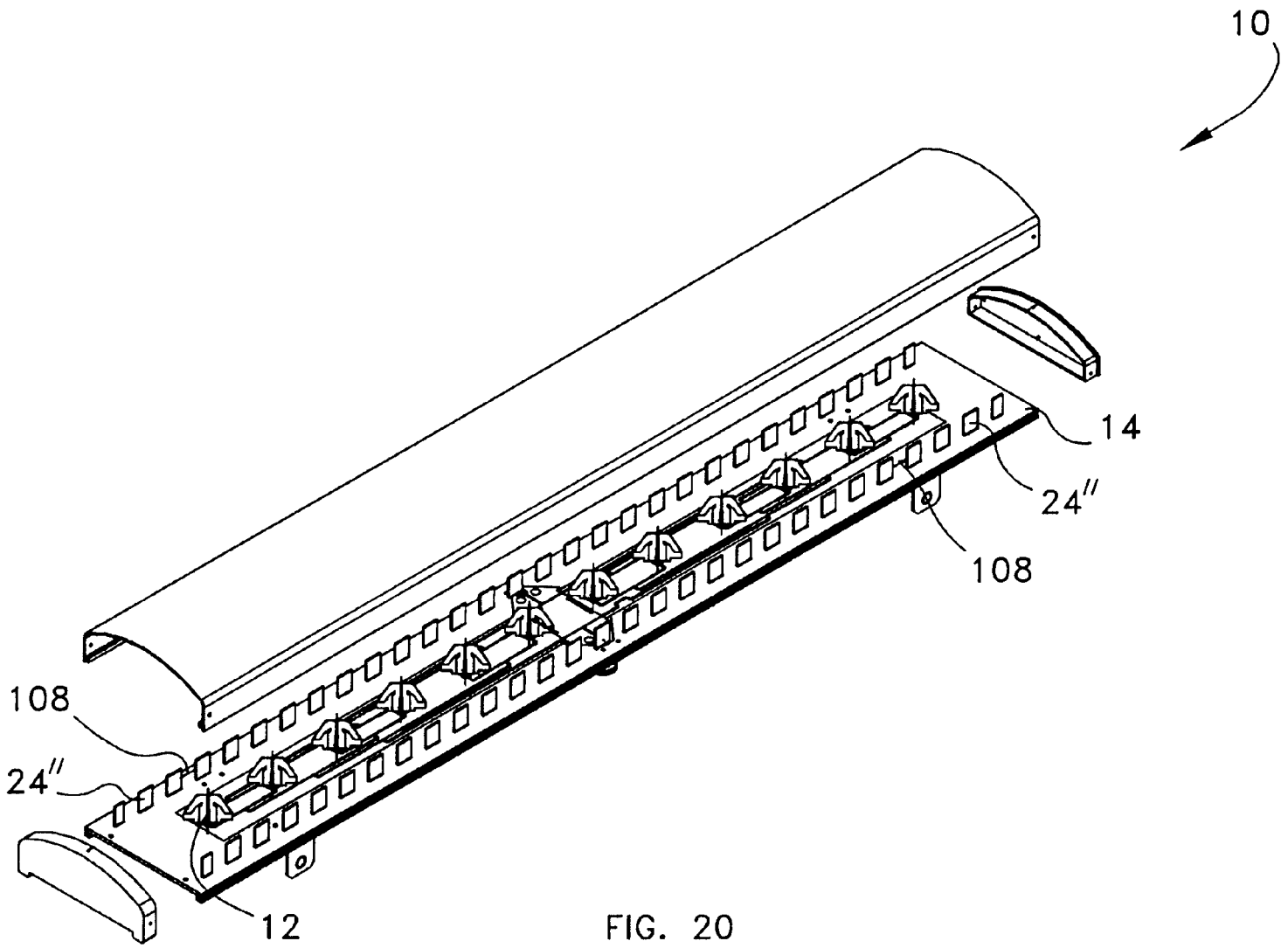
FIG. 20 is a block diagram illustrating a pair of side walls for an alternative embodiment of the present invention.

FIGS. 19 and 20 show alternative embodiments for spaced-apart side walls, respectively (1) spaced-apart, outwardly angled side walls and (2) parallel, non-solid side walls. This placement of spaced-apart side walls on either side of the radiating elements results in the reduction of the HPBW in the azimuth plane for antenna embodiments of the present invention. Turning first to FIG. 19, each angled side wall 24' includes a base 104 and a top edge 106. The base 104 of each angled side wall 24', which can be attached to the radio-electric ground plane 14 of the antenna tray, is spaced an equal distance from an axis extending along the major dimension of the antenna and connecting each center point of the array of radiating elements 12. Likewise, the top edge 106 of each angled side wall 24' is separated from the radiating elements by a second larger spacing that is equal distance from the referenced axis connecting each center point of the array of radiating elements. The angle for the slope of each outwardly angled side wall 24', as viewed from base to top edge, can be within a range of 30 to 90 degrees, as measured from the adjacent outside edge of the ground plane.

Referring now to FIG. 20, parallel, non-solid side walls 24" are similar to the parallel side walls design shown in FIGS. 2A–2B, with the exception that the conductive wall surfaces contain spacing or gaps 108. These gaps 108 can be spaced along a wall at a periodic interval or at irregular intervals. A typical spacing interval between each pair of gaps 108 is approximately ⅓ to ½ of a wavelength for the selected center frequency.

Figure 21:
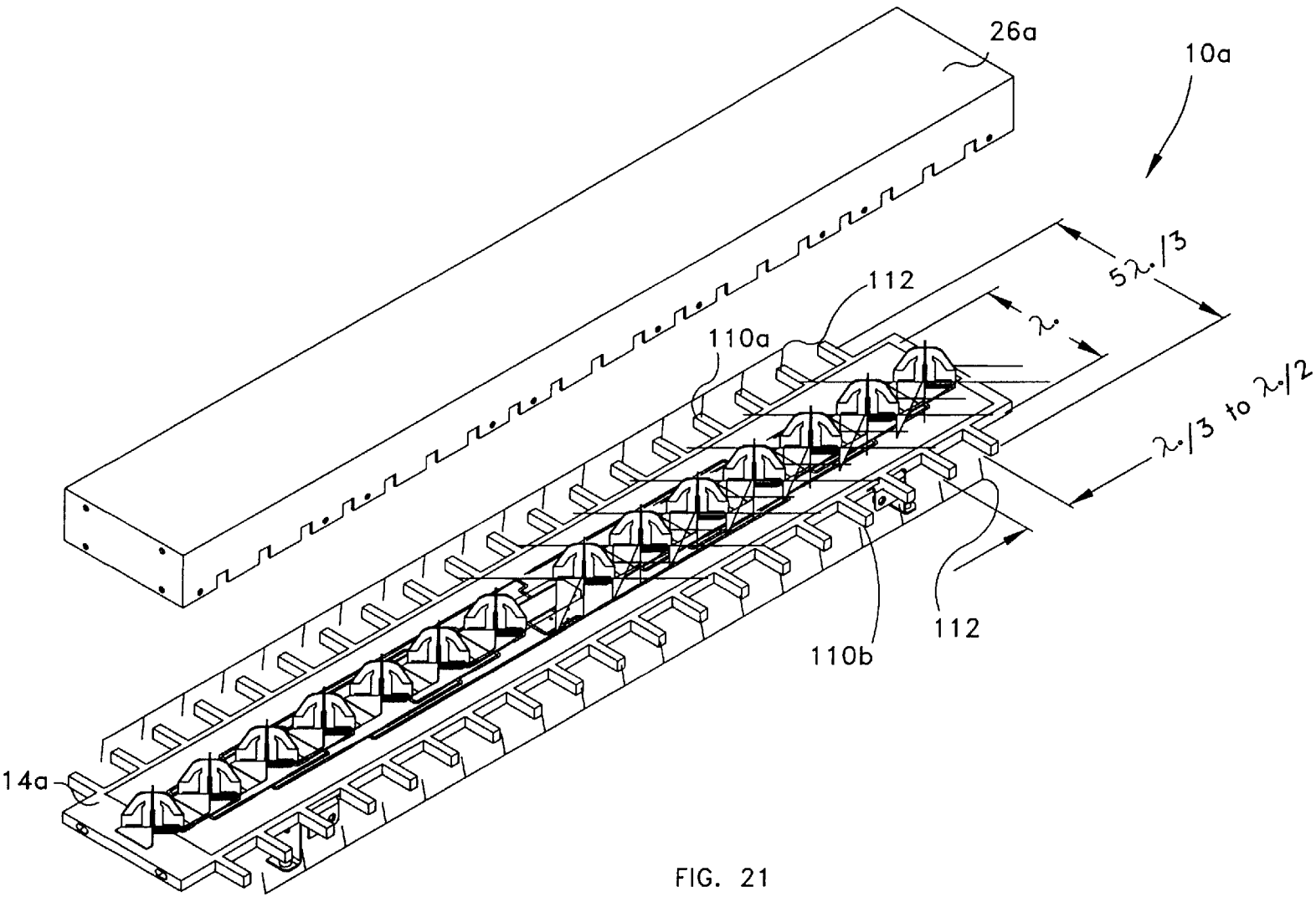
FIG. 21 is an illustration of a radio-electric ground plane for an alternative embodiment of the present invention.

FIG. 21 is an illustration of an alternative embodiment of a ground plane for an embodiment of the antenna. Referring to FIGS. 1 and 21, it will be understood that the transverse extent of a radio-electric ground plane is driven by the pattern and polarization characteristics of the horizontal polarization component with respect to the array where the horizontal component lies in the transverse plane. The electromagnetic boundary conditions for the horizontal polarization can be satisfied without significantly influencing the performance of the vertical polarization component. This can be achieved by the use of a non-solid conductive surface beyond the minimum transverse extent needed to achieve the desired performance characteristics for the vertical polarization component. This nonsolid conductive surface, shown in FIG. 21 as grids 110*a* and 110*b*, generally consists of a pair of grids, each having identically-sized, parallel conducting elements 112. The grids 110*a* and 110*b* are aligned in the horizontal plane of an antenna 10*a* and symmetrically located along the two edges forming the transverse extent of the antenna, i.e., the sides of the ground plane 14*a*. Typical construction techniques for each of the grids 110*a* and 110*b* can be an array of metal wires, rods, tubing, and strips. A radome 26*a* includes slots to accommodate the tips of each of the grid elements 112 for the grids 110*a* and 110*b*.

Measurement data confirms that the perpendicular (vertical) polarized energy is negligibly affected by the grids 110*a* and 110*b* for most geometries. A center spacing (S) of the elements 112 of each grid is approximately $S=\lambda_o/3$ to $\lambda_o/2$. This element spacing enables the grids 110*a* and 110*b* to effectively operate as an extension of the ground plane

14*a* and to avoid introducing a large transmission loss for the parallel (horizontal) polarization component.

If the grid elements 112 are implemented as conductive strips oriented edgewise to the face of the antenna 10*a*, then greater attenuation of the transmitted signal of the parallel polarization component is achieved and the reflectivity of the effective conductive surface increased. Hence, it will be understood that center-to-center spacing can be traded with depth to achieve the desired performance.

At PCS frequencies, empirical measurements have shown that a solid ground plane 14*a* having a transverse extent of 4–6 inches provides good performance for the vertical polarization component. For this physical implementation of the ground plane 14*a*, the grid elements 112 of the pair of horizontally-oriented grid 110*a* and 110*b* should have a length of approximately 2–3 inches for the application frequency range to produce the desired polarization and coverage results equivalent to a radio-electric ground plane having a solid conductive surface of 10 inches.

At cellular frequencies with a center frequency of 851 MHz, a solid surface ground plane 14*a* having a nominal transverse extent of 12 inches in combination with a pair of horizontal grids 110*a* and 110*b* having a grid element length of 6 inches is believed to offer a good electrical performance and reasonable wind loading characteristics. Consequently, the preferred configuration for the radio-electric ground plane at 851 MHz uses a hybrid system of a solid conductive surface and a pair of grids aligned adjacent to the solid conductive surface.

An additional benefit of the use of the grids is that the in-phase addition of fields from each section of the edge geometry in the back of the antenna array is partially destroyed, so as to effectively improve the front-to-back ratio pattern envelope performance for most signal polarizations.

At even lower frequencies of operation the use of the array of grid elements becomes more important from the viewpoint of a practical physical implementation. For example, at 450 MHz, the effective transverse radio-electric extent of the ground plane should be approximately 43 inches. By applying the principles of the present invention, the radio-electric ground plane can be implemented as a solid conductive surface of approximately 22 inches in combination with a pair of grid element arrays, each grid element extending approximately 10.5 inches along the length of the parallel sides of the solid conductive surface.

Figure 22:
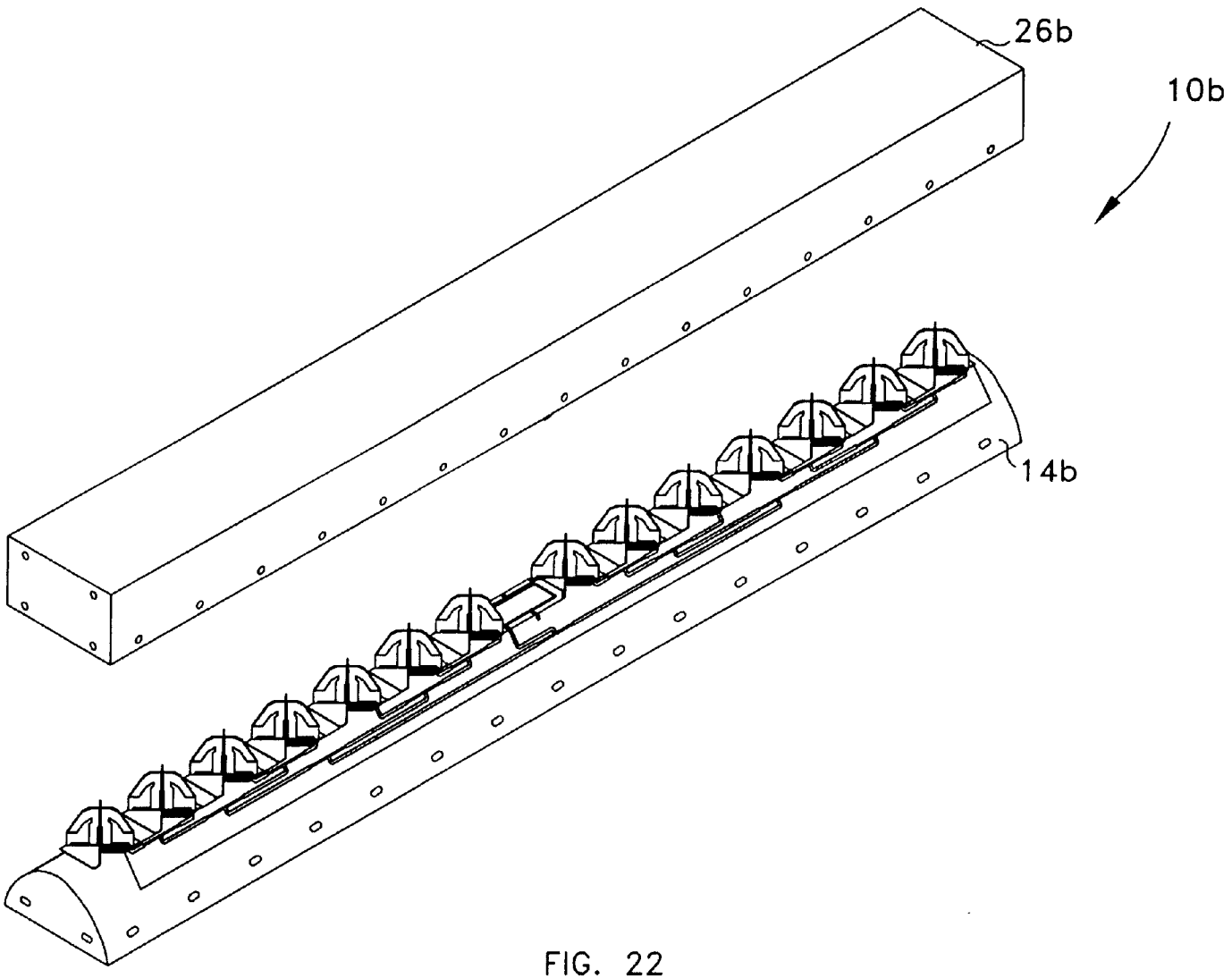
FIG. 22 is an illustration of a radio-electric ground plane for an alternative embodiment of the present invention.
Figure 23:
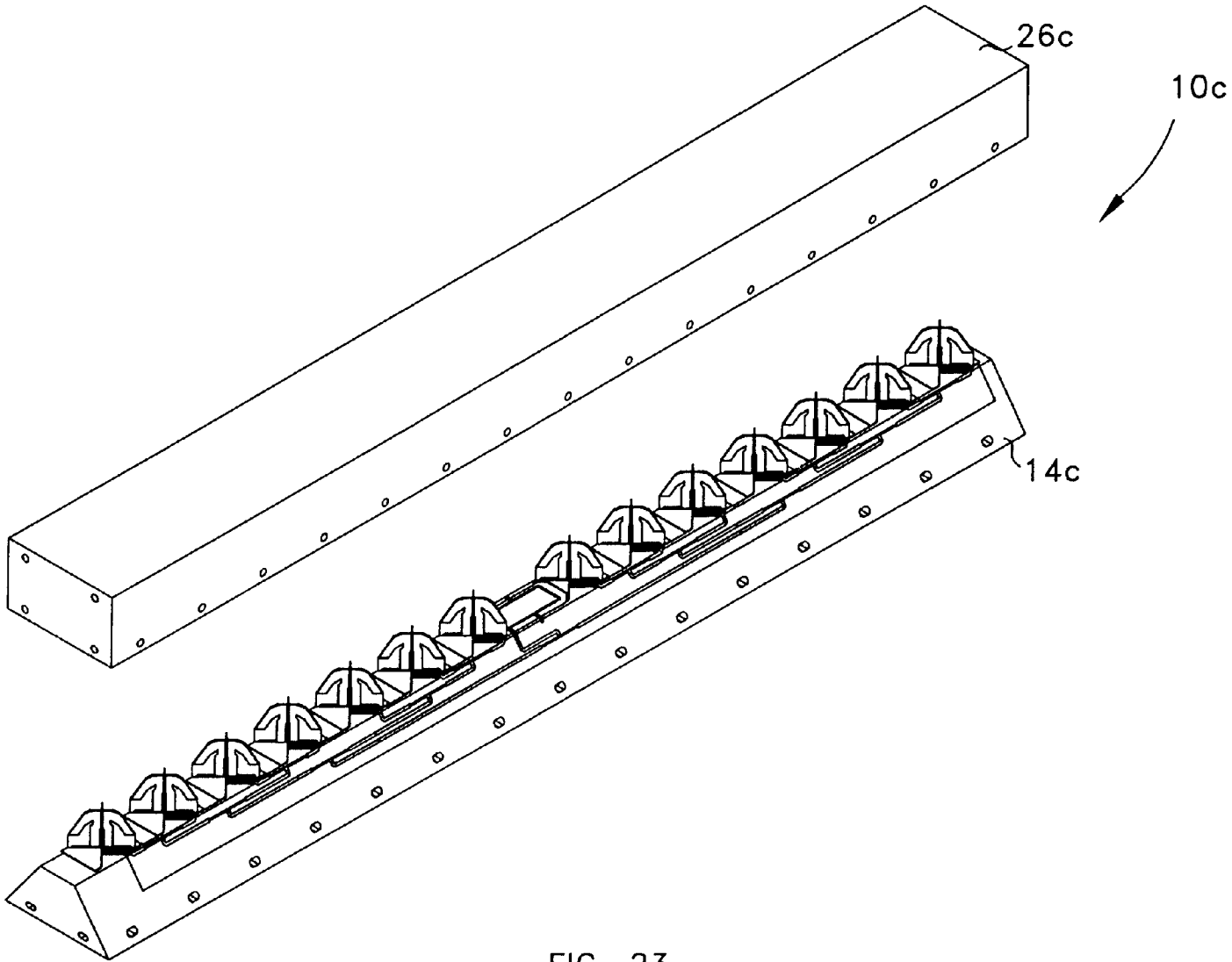
FIG. 23 is an illustration of a radio-electric ground plane for an alternative embodiment of the present invention.

FIGS. 22 and 23 are illustrations showing alternative radio-electric ground plane implementations for use with embodiments of the antenna represented by the present invention. Turning now to FIGS. 1, 22, and 23, FIG. 22 illustrates an antenna 10*b* having a "curved" ground plane 14*b*, whereas FIG. 23 illustrates an antenna 10*c* having a piece-wise "curved" ground plane 14*c*. The ground plane 14*b* is a conductive surface having a convex shape, wherein the radiating elements 12, BFN 16, and PCN 18 can be centrally mounted along the vertex of the outer edge of this semi-circle configuration of the radio-electric ground plane. In contrast, a ground plane 14*c* of an antenna 10*c* is a conductive surface having a piece-wise curved shape formed from a center horizontal element and a pair of angled elements extending along each side of the center horizontal element. Although the radiating elements 12 are preferably supported by the horizontal element of the ground plane 14*c*, the BFN 16 and the PCN 18 can be supported by the horizontal surface of the center element and the angled surfaces of the side elements. The curved nature of the ground planes 14*b* and 14*c* are intended to reduce the influence of the finite boundary of the conductive surface of the radio electric ground plane on the radiation characteristics of the antenna.

Figure 24:
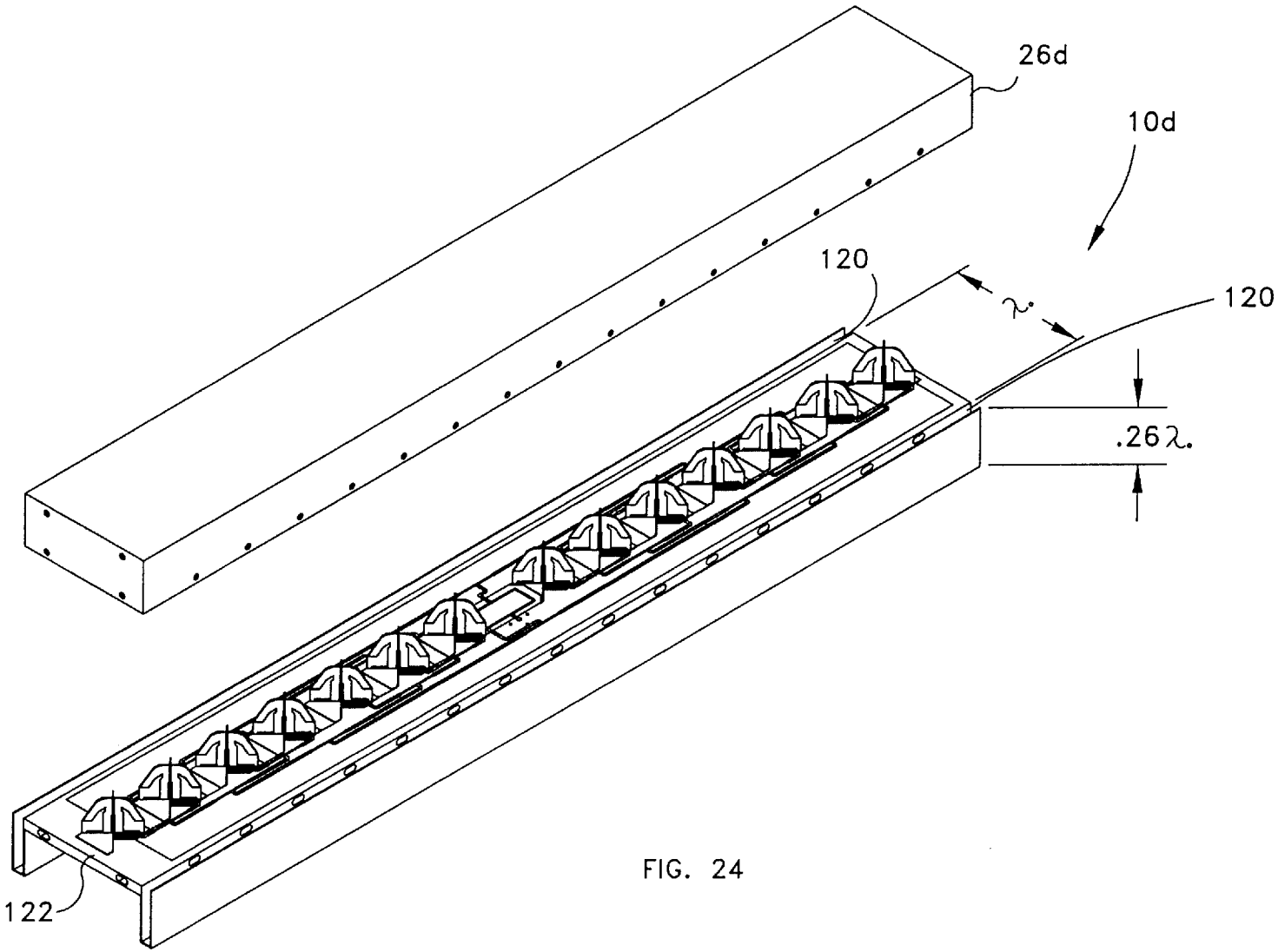
FIG. 24 is an illustration of a radio-electric ground plane for an alternative embodiment of the present invention.

Turning now to FIG. 24, an antenna 10*d* having one or more "choke" grooves 120 of depth of approximately one-quarter wavelength ($\lambda_o/4$) at the center frequency of the operating band along each edge of a solid ground plane 122 can reduce the net edge diffraction coefficient for the horizontal polarization component, and provide coverage pattern and polarization performance similar to a larger radio-electric ground plane. The dimensions of the ground plane 122 may be reduced to approximately one-wavelength ($\lambda_o$), with the opening of the choke groove 120 flush to the plane defined by the surface of the conducting plane of the ground plane 122. The choke groove 120 comprises a section of transmission line of a parallel-plate-type, and shorted at a distance of approximately one-quarter wavelength from the opening. The parallel plate transmission line may be folded around the back surface of the radio-electric ground plane to reduce the depth of the overall assembly. As shown in FIG. 24, a single choke groove 120 along side the major axis of the array is configured in a simple manner perpendicular to the plane and without folding.

There may be beneficial performance improvement from more than one choke groove along the major axis of the antenna. However, the benefit of the size reduction will diminish and approach the full size ($5\lambda_o/3$) ground plane while also adding depth to the assembly for a typical parallel plate width of one-tenth wavelength ($\lambda_o/10$) and two or more grooves per side. The added complexity of the assembly with two or more choke grooves per side is believed unattractive in comparison to the simplicity of the solid or hybrid solid/non-solid ground plane embodiments.

It will be understood that only the claims that follow define the scope of the present invention and that the above description is intended to describe various embodiments to the present invention. In particular, the scope of the present invention extends beyond any specific embodiment described within this specification.

What is claimed is:

1. An antenna system for transmitting and receiving electromagnetic signals having polarization diversity, comprising:

a plurality of dual polarized radiators, characterized by dual simultaneous polarization states, for generating substantially rotationally symmetric radiation patterns defined by a co-polarized pattern response having pseudo-circular symmetry properties and E- and H-plane patterns that are different by no more than approximately 3.1 dB at any value of theta over the field of view for the antenna system;

a distribution network, connected to each of the dual polarized radiators, for communicating the electromagnetic signals from and to each of the dual polarized radiators;

a ground plane positioned generally parallel to and spaced apart from the dual polarized radiators by a predetermined distance; and spaced-apart side walls, coupled to the ground plane, thereby forming a cavity surrounding the dual polarized radiators, each side wall placed a predetermined distance from each radiator and having a specified height.

2. The antenna system of claim 1, wherein the spaced-apart side walls operate in tandem with the ground plane to reduce the half power beamwidth within an azimuth plane.

3. The antenna system of claim 2, wherein the polarization states are orthogonal, thereby minimizing the cross-polarization response of any electromagnetic signal received by the antenna system.

4. The antenna system of claim 2, wherein the dual polarization states have electric centers that are co-located within the antenna system.

5. The antenna system of claim 2, wherein the ground plane has sufficient radio-electric extent in a plane transverse to the antenna system to image the dual polarized radiators over a wide coverage area, thereby enabling a radiation pattern within an azimuth plane of the antenna system to be independent of any quantity of the dual polarized radiators.

6. The antenna system of claim 2, wherein each of the dual polarized radiators comprises a crossed dipole pair having a first dipole element and a second dipole element positioned orthogonal to each other.

7. The antenna system of claim 6, wherein the polarization states of the dual polarized radiators are maintained for a wide coverage area (half power beamwidth) of at least 45 degrees in an azimuth plane of the antenna system.

8. The antenna system of claim 6, wherein the dual polarized radiators are positioned above the ground plane to form a linear array, each crossed dipole pair aligned along the ground plane within a vertical plane of the antenna system.

9. The antenna system of claim 6 further comprising a central polarization control network, connected between the distribution network and at least one antenna port, for controlling the polarization states exhibited by the dual-polarized radiators.

10. The antenna system of claim 6, wherein an electric plane of each dipole pair is +/−45 degrees with respect to a vertical axis of the antenna system.

11. The antenna system of claim 6, wherein the polarization states of the crossed dipole pair are a slant left polarization and a slant right polarization.

12. The antenna system of claim 6, wherein the radiation patterns comprise a first radiation pattern in an elevation plane of the antenna system and a second radiation pattern in an azimuth plane of the antenna system, the first radiation pattern defined by geometry of the antenna system and the second radiation pattern defined by the characteristics of the dual polarized radiators, the side walls, and the ground plane.

13. The antenna system of claim 1, wherein said dual polarized radiators have rotationally symmetric radiation patterns in response to a fixed linearly polarized electromagnetic signal having any orientation within 45 degrees of a co-polarized orientation on boresight of the antenna.

14. The antenna system of claim 1, wherein the radiators are centrally positioned as a linear array between the parallel, spaced-apart side walls and above a conductive surface of the ground plane.

15. The antenna system of claim 14, wherein each side wall comprises solid conductive material and is spaced an equal distance from an axis extending along the major dimension of the antenna and connecting each center point of the array of radiators.

16. The antenna system of claim 14, wherein each side wall comprises non-solid conductive material containing a plurality of gaps, wherein each pair of gaps is spaced-apart by a spacing interval of approximately ⅓ to ½ of a wavelength for the selected center frequency.

17. The antenna system of claim 14, wherein each side wall comprises a base and a top, wherein the base of each side wall is coupled to the ground plane and is spaced a first distance from an axis extending along the major dimension of the antenna and connecting each center point of the array of radiators, and the top of each side wall is separated from the radiators by a second distance from the axis, the second distance being larger than the first distance.

18. The antenna system of claim 17, wherein each side wall is formed as an integral element of the ground plane.

19. The antenna system of claim 17, wherein the side walls and the ground plane comprise conductive material, and wherein the base of each side wall is coupled to the ground plane by a transfer adhesive barrier comprising a dielectric material to prevent a direct connection between the side wall and the ground plane and to form a capacitive junction to suppress generation of passive intermodulation by the antenna system.

20. The antenna system of claim 17, wherein the angle for the slope of each outwardly angled side wall, as viewed from the base to the top, is within a range of 30 to 90 degrees, as measured from the outer edge of the ground plane.

21. The antenna of claim 1, wherein the distribution network comprises:

a printed circuit board (PCB) having a top element and a bottom element, wherein the distribution network is positioned along the top element;

a ground plane, comprising a continuous conductive surface, extending substantially along the bottom element, a plurality of machined slots, each positioned along the PCB at appropriate spaced-apart locations to support the mounting of the radiators for connection to the distribution network; and a plurality of plated-through holes, positioned along the PCB, for providing electrical connections from the top element to the bottom element of the PCB, whereby each plated-through hole boosts current carrying capability and reduces the RF impedance for the current path of each electrical connection.

22. The antenna of claim 21, wherein each dual polarized radiator comprises a crossed dipole pair having a first dipole element and a second dipole element, and each of the first and second dipole elements comprises:

a dielectric substrate having a first side and a second side;

a dipole comprising conductive material etched on the first side of the dielectric substrate, the dipole characterized by a pair of dipole arms connected to a dipole body having a pair of legs, each leg connected to one of the dipole arms; and a transmission feed line comprising conductive material etched on the second side of the dielectric substrate, the transmission feed line including a balun proximate to a base of the second side of the dielectric substrate.

23. The antenna of claim 22, wherein each dipole arm has a width selected to present a certain operating impedance for the operational frequency band of the antenna.

24. The antenna of claim 22, wherein each dipole leg comprises a first end connected to the corresponding dipole arm and a second end opposite the connection to the corresponding dipole arm, and the second end is wider than the first end to provide a radio-electric ground plane for the transmission feed line on the second side of the dielectric substrate.

25. The antenna of claim 22, wherein each of the first and second dipole elements is mounted to the PCB at one of the machined slots, and each dipole leg of the corresponding mounted dipole element is connected to the ground plane on the bottom element of the PCB.

26. The antenna of claim 22, wherein the first and second dipole elements are positioned orthogonal to each other and form a crossed dipole pair having an intersection at a crossing location of the first and second dipole elements, the intersection comprising a microstrip transition.

27. The antenna of claim 26, wherein the transmission feed line is connected to the distribution network and terminated in an open circuit termination having a length of approximately one-quarter wavelength long as measured from the crossing location of the crossed dipole pair.

28. The antenna of claim 26, wherein the dielectric substrate of the first dipole element comprises a first vertical slot extending from the base substantially along the center of the dielectric substrate and between the dipole legs, and the dielectric substrate of the second dipole element comprises a second vertical slot extending from the top substantially along the center of the dielectric substrate and between the dipole arms, and the crossed dipole pair is formed by sliding the first vertical slot into the second vertical slot.

29. The antenna of claim 28, wherein the transmission feed lines of the first and second dipole elements alternate in an over-under arrangement within the intersection formed by the crossed dipole pair to prevent an electrical connection between the transmission feed lines.

30. A microstrip-implemented beam-forming network for an antenna having an array of radiating elements, comprising:

a printed circuit board (PCB) having a top element and a bottom element;

a distribution network, etched as a microstrip circuit along the top element and connected to each of the radiating elements, for communicating electromagnetic signals from and to each of the radiating elements;

a ground plane, comprising a continuous conductive surface, extending substantially along the bottom element, a plurality of machined slots, each positioned along the PCB at appropriate spaced-apart locations to support the mounting of the radiating elements for connection to the beam forming network; and a plurality of plated-through holes, positioned along the PCB, for providing electrical connections from the top element to the bottom element of the PCB, whereby each plated-through hole boosts current carrying capability and reduce the RF impedance for the current path of the electrical connection.

31. The beam-forming network of claim 30, wherein a transfer adhesive barrier, comprising a dielectric material, attaches the conductive surface along the bottom element of the PCB to a conductive ground plane of the antenna, thereby forming a capacitive junction that operates to suppress passive intermodulation by preventing a direct current connection between the conductive surface and the conductive ground plane.

32. The beam-forming network of claim 31, wherein the periphery of each machined slot is relieved to remove any unintentional conductive surface, thereby further supporting the suppression of passive intermodulation by eliminating a direct current connection between a conductive surface of one of the radiating elements and the conductive surface of the ground plane along the bottom element of the PCB.

33. The beam-forming network of claim 31, wherein each edge along the periphery of the PCB is relieved to remove any unintentional conductive surface, thereby further supporting the suppression of passive intermodulation by eliminating a direct current connection between the conductive surface of ground plane on the bottom element of the PCB and the conductive surface of the ground plane of the antenna.

34. The beam-forming network of claim 31, wherein at least one of the plated-through holes is positioned at each of the machined slots to provide a ground potential connection from the ground plane along the bottom element of the PCB to the radiating element mounted in the machined slot.

35. A method for assembling a beam-forming network of an antenna having an array of radiating elements, the beam-forming network comprising a printed circuit board (PCB) having a top element and a bottom element, a distribution network, etched as a microstrip circuit along the top element and connected to each of the radiating elements, for communicating electromagnetic signals from and to each of the radiating elements, a ground plane, comprising a continuous conductive surface, extending substantially along the bottom element, a plurality of machined slots, each positioned along the PCB at appropriate spaced-apart locations to support the mounting of the radiating elements for connection to the beam-forming network, and a plurality of plated-through holes, positioned along the PCB, for providing electrical connections from the top element to the bottom element of the PCB, comprising the steps of:

applying solder mask and paste at desired solder locations on the PCB;

inserting the radiating elements within the machined slots;

passing the assembled beamforming network through a reflow oven to achieve the solder connections at the desired solder locations.

36. The method of claim 35, wherein a localized heating source applies heat to the areas requiring solder connections on the PCB.

37. An antenna system for transmitting and receiving electromagnetic signals, comprising:

a plurality of dual polarized radiators, each comprising a crossed dipole pair having a first dipole element and a second dipole element positioned orthogonal to each other;

a distribution network, connected to each of the radiators, for communicating the electromagnetic signals between an input port and each of the radiators; and a ground plane positioned generally parallel to and spaced apart from the radiators, wherein each radiator of the crossed dipole pair has a non-identical reflection coefficient, thereby terminating the distribution network to achieve a desired network input impedance by allowing phase and amplitude characteristics of the reflection coefficients of the first and second dipole elements to cancel reflected energy at the network input port.

38. The antenna system of claim 37, wherein each of the first and second dipole elements comprises:

a dielectric substrate having a first side and a second side;

a dipole comprising conductive material etched on the first side of the dielectric substrate, the dipole characterized by a pair of dipole arms connected to a dipole body having a pair of legs, each leg connected to one of the dipole arms; and a transmission feed line comprising conductive material etched on the second side of the dielectric substrate.

39. The antenna system of claim 38, wherein the transmission feed line for the first dipole element comprises a balun and the transmission feed line for the second dipole element comprises a reciprocal image of the balun.

40. The antenna system of claim 38, wherein the transmission feed line for first dipole element comprises a first balun and the transmission feed line for the second dipole element comprises a second balun, wherein the first balun comprises transmission characteristics different from the second balun.

41. The antenna system of claim 38, wherein the first dipole element further comprises a plate of conductive material on the second side of the dielectric substrate, the plate positioned proximate to an end of one of the dipole arms opposite the dipole body on the first side of the dielectric substrate, for providing a capacitive load of the first dipole element and resulting in a change in impedance as measured at the input to the transmission feed line of the first dipole element.

42. The antenna system of claim 38, wherein one of the dipole arms comprises a longer length of conductive material than the remaining dipole arm, the difference in lengths of the dipole arms resulting in a variation in the input impedance as measured at the input to a balun of the first dipole element.

43. The antenna of claim 38, wherein the first and second dipole elements are positioned orthogonal to each other and form an intersection at the crossing location, the intersection comprising a microstrip transition.

44. The antenna of claim 38, wherein the dielectric substrate of the first dipole element comprises a first vertical slot extending from a base substantially along the center of the dielectric substrate and between the dipole legs, and the dielectric substrate of the second dipole element comprises a second vertical slot extending from a top substantially along the center of the dielectric substrate and between the dipole arms, and the crossed dipole pair is formed by sliding the first vertical slot into the second vertical slot.

45. The antenna system of claim 38, wherein the distribution network comprises a plurality of two-way power dividers, each connected to one of the dual polarized radiators and comprising an impedance transformer section including a pair of high impedance transmission lines having unequal lengths to achieve the effective cancellation of signal reflections across the operational frequency band of the antenna system.

46. The antenna system of claim 45, wherein the unequal lengths of the high impedance lines cancel reflected energy at a beamforming network input port and achieving a desired network impedance across the operational frequency band.

* * * * *